US005591561A

United States Patent [19]

Arai et al.

[11] Patent Number: 5,591,561

[45] Date of Patent: Jan. 7, 1997

[54] METHOD FOR PROCESSING BLACK-AND-WHITE SILVER HALIDE PHOTOGRAPHIC LIGHT-SENSITIVE MATERIAL

[75] Inventors: Takeo Arai; Junichi Fukawa, both of Hino, Japan

[73] Assignee: Konica Corporation, Japan

[21] Appl. No.: 599,024

[22] Filed: Feb. 9, 1996

[30] Foreign Application Priority Data

Feb. 15, 1995 [JP] Japan ..... 7-026596

[51] Int. Cl.[6] ..... G03C 5/30; G03C 5/305; G03C 5/31

[52] U.S. Cl. ..... 430/264; 430/399; 430/405; 430/448; 430/955; 430/963

[58] Field of Search ..... 430/264, 405, 430/448, 399, 955, 963

[56] References Cited

U.S. PATENT DOCUMENTS

| | | | |
|---|---|---|---|
| 3,260,598 | 7/1966 | Yutzy et al. | 430/404 |
| 4,740,363 | 4/1988 | Hirai et al. | 430/203 |
| 4,740,445 | 4/1988 | Hirai et al. | 430/203 |
| 4,874,687 | 10/1989 | Itabashi | 430/446 |
| 5,236,816 | 8/1993 | Purol et al. | 430/492 |
| 5,441,847 | 5/1995 | Fukawa et al. | 430/264 |

FOREIGN PATENT DOCUMENTS 0631179 12/1994 European Pat. Off. .

*Primary Examiner*—Richard L. Schilling
*Attorney, Agent, or Firm*—Bierman and Muserlian

[57] ABSTRACT

A method for processing a black-and-white silver halide photographic light-sensitive material comprising the steps of (1) developing an imagewise exposed black-and-white silver halide photographic light-sensitive material with a developing solution in the presence of a complex forming compound, (2) fixing with a fixing solution, (3) washing or stabilizing with water or a stabilizing solution, respectively, and (4) drying the washed or stabilized light-sensitive material, wherein the light-sensitive material comprises a support and at least one silver halide emulsion layer and optionally one or more non-light-sensitive hydrophilic colloid layers provided on a first side of the support, and a layer provided on the second side opposite to the fist side of the support, and at least one of the silver halide emulsion layer and the non-light sensitive hydrophilic layer adjacent to the silver halide emulsion layer provided on the first side of the support contains a hydrazine compound, at least one of the silver halide emulsion layer and the non-light sensitive hydrophilic layers provided on the first side of the support contains a redox compound capable of releasing a development inhibitor upon oxidation reaction, the layer provided on the second surface of the support contains a sparingly water-soluble metal compound capable of releasing a base upon reaction with the complex forming compound.

14 Claims, No Drawings

METHOD FOR PROCESSING BLACK-AND-WHITE SILVER HALIDE PHOTOGRAPHIC LIGHT-SENSITIVE MATERIAL

FIELD OF THE INVENTION

The present invention relates to a method for processing a black-and-white silver halide photographic light-sensitive material (hereinafter also simply referred as a light-sensitive material), particularly relates to a mehod suitable for rapid processing a silver halide photographic material for agraphic art.

BACKGROUND OF THE INVENTION

Recently, in the market of scanner for graphic art, a high precision screening method or FM screening method is become to be popularized in which an image is composed by dots smaller than those in an usual screening method. An ultra high-contrast light-sensitive material is suitable for such high precision screening method, by which a small dot having a high density can be easily formed. Various techniques have been known for forming an ultra high contrast image. These techniques include, for example, a light-sensitive material containing a hydrazine compound described in U.S. Pat. No. 4,269,929 and a light-sensitive material containing a nucleation accelerating agent described in Japanese Patent Publication Open for Public Inspection (JP O.P.I.) No. 4-98239/1992. Further, a technique for improving the photographic properties of a light-sensitive material is described in JP O.P.I. No. 6-347953/1954, in which a compound capable of releasing a photographically effective group by a redox reaction is added to a light-sensitive material containing a hydrazine compound. However, a light-sensitive material is made to be sensitive to variation in the developing activity of developer by addition of such redox compound and the light sensitivity of the light-sensitive material is apt to become unstable. The above facts result not preferable problems in the light-sensitive material to be applied for a high precision output method or FM screening method. In such screening methods, the reproducibility of dot image (in the linearity and dot quality) is easily varied depending on changing in the development activity of the developer.

On the other hand, a light-sensitive material, particularly a light-sensitive material for graphic art use, is usually processed after imagewise exposure, by an automatic processing machine having four steps of processing i.e., developing, fixing, washing or stabilizing, and drying. In the automatic processing machine, a developing solution, a fixing solution, and washing water or a stabilizing solution are charged in each processing tanks corresponding to the above-mentioned each processing steps, hereinafter these processing solutions are each referred as developer, fixer and stabilizer, respectively. Recently, it is required to shorten the time for processing. It has been usual that the total time for the processing, i.e., the duration between the time at which the fore front of a light-sensitive material is insert into the processing machine and the time the fore front of the light-sensitive material is come out from a drying zone of the processing machine (dry to dry) is 90 seconds or more. However, the processing is recently required to rapidly perform so as the total time to be shoten by 60 seconds or less. Further, it is required to reduce a waste liquid of photographic processing with respect to environment problems. Although there are various ways for reducing the waste liquid, it is effective to reduce the amounts of a repleniser solution for developer and a replenishing solution for fixer replenisher, hereinafter these are referred as developer replenisher and fixer replenisher, respectively.

It has been usual that the replenishing amounts for developer and fixer are each 400 ml per square meter of the light-sensitive material to be processed, respectively. However, it is recently required to reduce the replenishing amounts for developer and fixer by 300 ml per square meter of the light-sensitive material to be processed. The above-mentioned problems are brcome more seriousin such the cases of rapid processing or processing with reduced replenishing. Further, the development activity of developer and the sensitivity of the light-sensitive material is lowered by reducing of the replenishing amount of the developer. As a countermeasure to such problem, a technique is described JP O.P.I. Nos. 63-118746/1988, 63-128338/1988, 63-188132/1988, 63-188133/1988, 2-235044/1990 and 63-101846/1988 in which a compound capable of releasing a base is contained in a hydrophilic colloid layer for maintaining the sensitivity of the light-sensitive material at a constant level.

However, the above-mentioned technique hardly be made practicable particularly in a light-sensitive material containing a hydrazine compound and a redox compound capable of releasing a photographically effective group, because the application of such technique causes degradation in the sensitivity, contrast and quality of dot image, and increasing in fine black spots formed in the unexposed area of light-sensitive material. The black spot formation is a phenomenon peculiarly observed in a light-sensitive material containing a hydrazine compound.

Although it is effective for preventing the environment pollution to use a developer containing no hydroquinone, the above-mentioned problems are further strengthen in such case.

SUMMARY OF THE INVENTION

The object of the invention is to provide a silver halide photographic light-sensitive material which is prevented from degradation in the photographic properties when the light-sensitive material is processed in a condition with a reduced replenishing amount and is excellent in the linearity.

The above object of the invention is achieved by a method for processing a black-and-white silver halide photographic light-sensitive material which comprises the steps of developing an imagewise exposed black-and-white silver halide photographic light-sensitive material with a developing solution in the presence of a complex forming compound; fixing the developed light-sensitive material with a fixing solution; washing or stabilizing the fixed light-sensitive material with water or a stabilizing solution, respectively; and drying the washed or stabilized light-sensitive material. In the above, the light-sensitive material comprises a support, at least one silver halide emulsion layer and optionally one or more non-light-sensitive hydrophilic colloid layers provided on a first side of the support, and a layer provided on a second side of the support opposite to the first side; and at least one of the silver halide emulsion layer and the non-light sensitive hydrophilic layer adjacent to the silver halide emulsion layer provided on the first side of the support contains a hydrazine compound; at least one of the silver halide emulsion layer and the non-light sensitive hydrophilic layers provided on the first side of the support contains a redox compound capable of releasing a development inhibitor upon redox reaction; and the layer provided on the second side of the support contains a sparingly water-soluble metal compound capable of releasing a base upon reaction with the cpmplex forming compound. The present invention is described in detail below.

In the light-sensitive material relating to the present invention, a layer provided on the side of the support opposite to the surface on which the silver halide emulsion layer is provided, such as a backing layer or a backing protective layer, contains a sparingly water-soluble compound capable of releasing a base, hereinafter referred as base-releasing metal compound. The base-releasing metal compound is preferably one having a water-solubility of not more than 0.5 at 20° C. and represented by the following formula. The solubility is defined as the amount of a substance in grams which can be dissolved in 100 grams of water.

Tm Xn

In the above, T represents a transition metal such as Zn, Cu, Al, Co, Fe or Mn, or an alkali-earth metal such as Ca, Ba or M; and X represents an alkaline ion or an atom which is capable of being a counter ion of M in the later-mentioned complex forming compound in water for example, a carbonate ion, phosphate ion, silicate ion, borate ion, aluminate ion, hydroxyl ion or oxygen atom. m and n are each an integer for equalizing the atomic valences of T and X, respectively.

Examples of preferable compounds are described below: calcium carbonate, barium carbonate, magnesium carbonate, zinc carbonate, strontium carbonate, magnesium-calcium carbonate ($CaMg(CO_3)_2$), magnesium oxide, zinc oxide, tin oxide, cobalt oxide, zinc hydroxide, aluminum hydroxide, magnesium hydroxide, calcium hydroxide, antimony hydroxide, tin hydroxide, iron hydroxide, bismuth hydroxide, manganese hydroxide, calcium phosphate, magnesium phosphate, magnesium borate, calcium silicate, magnesium silicate, zinc aluminate, calcium aluminate, zinc basic carbonate ($2ZnCO_3.3Zn(OH)_2.H_2O$), magnesium basic carbonate ($3MgCO_3.Mg(OH)_2.3H_2O$), nickel basic carbonate ($NiCO_3.2Ni(OH)_2$), bismuth basic carbonate ($Bi_2(CO_3)O_2.H_2O$), cobalt basic carbonate ($2CoCO_3.3Co(OH)_2$), aluminum magnesium oxide, copper hydroxide and copper basic carbonate.

Among these compounds, colorless ones are specifically preferable.

In the present invention, a complex forming compound to be added to a developer replenisher, or a developer according to necessity, is one capable of forming a complex having a stability constant logK of not less than 1 with a metal ion composing the above-mentioned base-releasing metal compound.

These complex forming compounds are described in detail in A. E. Martell & R. M. Smith "Critical Stability Constants" vol. 1–5, Plenum Press.

These compounds include, for example, salts aminocarbonic acids, iminodiacetic acid and its derivative, anillinocarbonic acids, pyridinocarbonic acids, aminophosphoric acids, carbonic acids including mono-, di-, tri- and tetracarbonic acids and those having a substituent such as a phosphono group, hydroxy group, oxo group, ester group, amido group, alkoxy group, mercapto group, alkylthio group or phosphino group, and salts of hydroxamic acids, polyacrylates and polyphosphoric acids, with an alkali metal, guanidine, amidine or quartenary ammonium compound.

As preferable examples of them, alkali metal salts of picolinic acid, 2,6-pyridine-dicarbonic acid, 2,5-pyridine-dicarbonic acid, 4-dimethylaminopyridine-2,6-dicarbonic acid, quinoline-2 carbonic acid, 2-pyridylacetic acid, oxalic acid, citric acid, tartaric acid, isocitric acid, malic acid, gluconic acid, EDTA, NTA, CDTA, hexamtaphosphoric acid, tripolyphosphoric acid, tetraphosphoric acid, polyacrylic acid,

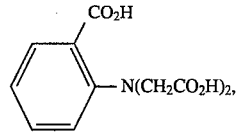

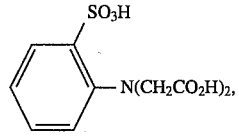

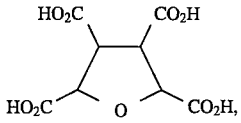

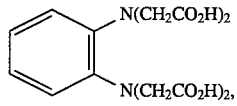

$HO_2CCH_2OCH_2CH_2OCH_2CO_2H$, $HO_2CCH_2OCH_2CO_2H$ and

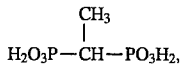

guanidines, amidines or quartenary ammonium compounds are preferably usable.

Among them, aromatic heterocyclic compounds having at least one —$CO_2M$ group and a nitrogen atom in the ring thereof are particularly preferable. The aromatic heterocyclic compounds may be ones each having single ring or condensed ring such as pyridine ring and quinoline ring. It is particularly preferable that the position at which the —$CO_2M$ group is bonded at a-position with respect to the nitrogen atom. The above M is an alkali metal, guanidine, amidine or quartenary ammonium.

Further preferable compounds are ones represented by the following formula.

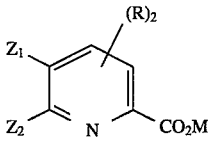

In the above formula, R represents a hydrogen atom or an electron donating group such as an alkyl group, an aryl group, a halogen atom, an alkoxyl groupor an amino group which may have a substituent such as qn alkyl group. Two groups represented by R may be the same or different. M is synonymous with M in the above mentioned —$CO_2M$.

$Z_1$ and $Z_2$ are each the same as R defined in the above. $Z_1$ and $Z_2$ may be linked to form a ring condensed with the pyridine ring.

The most preferable examples of combination of the base-releasing metal compound and the complex forming compound are listed below, in the followings, $M^+$ represents an alkali metal, a substituted or unsubstituted guanidinium ion, an amidinium ion or a quartenary ammonium ion.

Calcium carbonate -

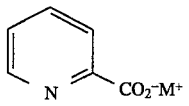

Zinc basic carbonate -

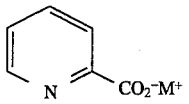

Magnesium basic carbonate -

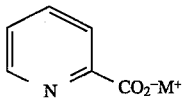

Zinc oxide -

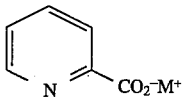

Zinc hydroxide -

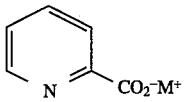

Aluminum hydroxide -

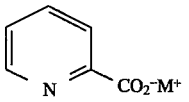

Zinc basic carbonate -

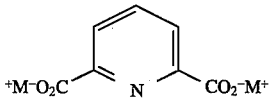

Magnesium basic carbonate -

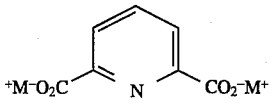

Calcium carbonate -

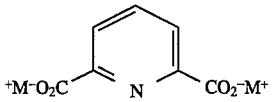

Zinc oxide -

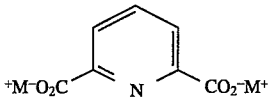

Calcium carbonate -

-continued $^+M^-O_2C.CO_2^-M^+$

Calcium carbonate -

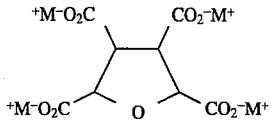

Barium carbonate -

$^+M^-O_2C-CO_2^-M^+$

Calcium carbonate -

Salt of tripolyphosphoric acid with $M^+$

Calcium carbonate -

Salt of citric acid with $M^+$

Calcium carbonate -

Salt of polyacrylic acid with $M^+$

Calcium carbonate -

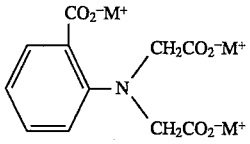

Magnesium oxide -

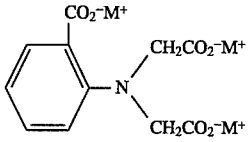

Zinc hydroxide -

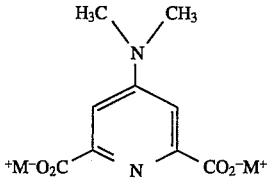

Tin hydroxide -

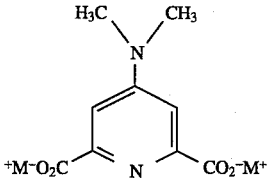

Magnesium hydroxide -

Salt of hexametaphosphoric acid with $M^+$

Calcium carbonate -

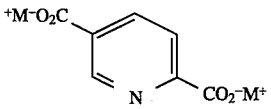

-continued

Zinc hydroxide -

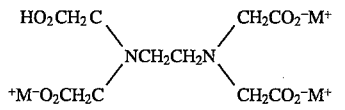

Zinc hydroxide -

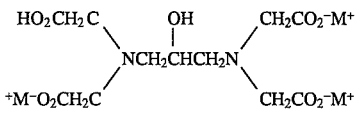

Magnesium basic carbonate -

$^{+}M^{-}O_2C.CO_2^{-}M^{+}$

Calcium carbonate -

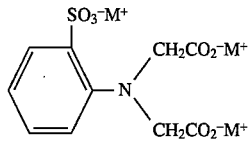

Zinc basic carbonate -

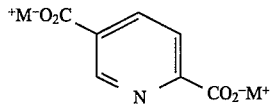

The above-mentioned pairs may be used singly or in combination.

The mechanism of forming a base in the developer in the present invention is described based on an example of the combination of potassium picolinate and zinc hydroxide. The reaction between both compounds are show as follows:

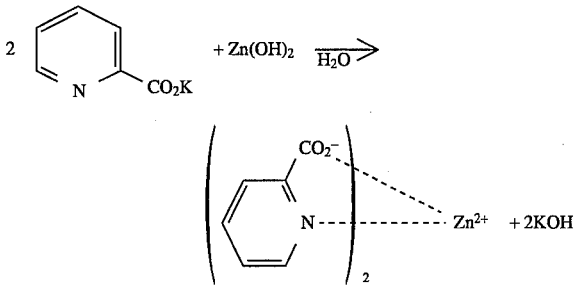

The above-mentioned complex forming reaction between picolinate ion and zinc ion is progressed by participation of water in the developer. As result of the reaction, a base is formed.

The progression of the reaction is caused by the stability of the formed complex. The stability constants ML, $ML_2$ and $ML_3$ of the complex formed from picolinate ion ($L^-$) and zinc ion ($M^+$) are considerably large as shown below. These values clearly support progression of the reaction.

| | ML | $ML_2$ | $ML_3$ |
|---|---|---|---|
| logk | 5.30 | 9.62 | 12.92 |

It is preferable that the base-releasing metal compound is contained in a light-sensitive material in the form of fine particle dispersion prepared by the method described in JP O.P.I. Nos. 59-174830/1984 and 53-102733/1978. The average particle size is preferably not more than 50 μm, particularly not more than 5 μm.

In the present invention, the base-releasing metal compound is added to a backing layer provided on the surface of the support opposite to the emulsion layer provided surface. Although the adding amount of the base-releasing metal compound is varied depending on the supplying method of the developer replenisher, the kind of the complex forming compound, the kind of the base-releasing metal compound, particle size and the processing temperature, the amount of that is to be the amount necessary to compensate alkali consumed in the processing. The amount is usually about 0.01 to 20 g, preferably 0.1 to 5 g/m$^2$.

Although the complex forming compound is added to the developer replenisher, it may be optionally added also to the developer or both of these solutions.

When the complex forming compound is contained in the developer, a base is formed in proportion to the amount of the light-sensitive material introduced in the developer. As a result of that, the pH vale of the developer can be maintained at a constant level.

Accordingly, necessity of supply of base through the developer replenisher becomes to be not or small and the pH value of the developer replenished can be lowered.

Therefore, the concentration of the developer replenisher can be made to higher and the using amount thereof can be reduced, when a type of developing agent such as a solubility of which is become higher in a lower pH environment such as p-phenylenediamine derivative usually used as a color developing agent, is used.

When the complex forming compound is contained in the developer replenisher, an usual alkaline agent such as $K_2CO_3$, $Na_2CO_3$ or $K_3PO_4$ become not to be necessary. Therefore, the ion strength in the solution can be lowered and the solubility of the developing agent can beraised. As a result of that, it can be realized to make higher the concentration of developer replenisher and to reduce the amount of replenishing.

It is necessary to raise the concentration of developing agent for reducing a replenishing amount. However, it is difficult to raise the developing agent concentration in a aqueous solution with a high ion strength. Contrary to that, according to the invention, the concentration of the developing agent can be advantageously raised without the restriction caused by pH value and ion strength in the replenisher solution. Further, a specific advantage can added to the replenishing method with reduced amount of the replenisher according to the invention, because a lowered pH value can be selected at which the oxidation of the developing agent by air can be prevented.

The amount of the complex forming compound to be contained in the developer replenisher, or optionally added to the developer, is varied depending on the replenishing procedure of the replenisher, pH of the developer and the kind of the complex forming compound. Generally, the preferable amount of the complex forming compound in the developer replenisher is 0.01 to 5 moles per liter. and that in the developer is also 0.01 to 5 moles per liter.

The developer replenisher or the developer preferably contains an amount of the complex forming compound so that the amount of the complex forming compound is larger than that of the base-releasing metal compound in moles contained in the light-sensitive material being processed in the developing tank. Under such condition, the amount of formed base can be in proportion to the processing amount, more exactly to the amount of development reaction, of the processed amount of the light-sensitive material.

Examples of the redox compound usable in the invention, which is capable releasing a development inhibitor when the compound is oxidized, include hydroquinones, catecholes, naphtohydroquinones, aminophenoles, pyrazolidones, hydrazines, hydroxylamines and reductones may be described. Compounds represented by the following Formula R-I are preferably used as the redox compound.

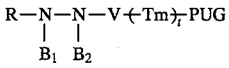

Formula R-I

In Formula R, $B_1$ and $B_2$ are each a hydrogen atom, sulfinic acid residue an acyl group, which may be the same or different. Example the sulfinic acid residue includes an alkylsulfonyl group having 20 or less carbon atoms, an arylsulfonyl group, preferably a phenylsulfonyl group or a phenylsulfonyl group substituted with a group so that the sum of substituents constants of Hammett is −0.5 or more.

The term "sulfinic acid residue" is herein defined as the residue produced by the removal of the acid hydrogen from a sulfinic acid. The sulfinic acid residue can be produced from an conventional sulfinic acid. The sulfonyl group of the sulfinic acid can be bonded directly to either an aliphatic or aromatic group. The aliphatic group can, for example, be an alkyl substituent. A simple alkyl substituent can take the form of alkyl of from 1 to 8 carbon atoms, most typically 1 to 3 carbon atoms. In a prefer form of the sulfinic acid residue includes an aromatic group. A preferred substituent can be represented by the following:

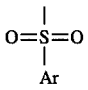

wherein Ar is an aryl group. In a specifically preferred form of the invention, Ar is a carbocyclic aromatic group containing 6 to 10 carbon atoms such as phenyl or naphthyl group, which can optionally be substituted. While wither electron withdrawing or electron donating substituents can be employed, highly electron donating substituents are nor preferred. Substituents other than ballasting groups typically contain up to 8 carbon atoms.

Example of the acyl group represented by $B_1$ and $B_2$ includes groups represented by $—[C(O)]_l—R_0$, in which $R_0$ is a straight- or branched-chain alkyl group having 30 or less carbon atoms and l is 1, 2 or 3, an alkenyl group, an aryl group preferably a phenyl group or a phenyl group substituted with a group so that the sum of substituents constants of Hammett is −0.5 or more, an alkoxyl group such as an ethoxy group, or an aryloxy group preferably one having single ring. These groups each may have a substituent. As the substituent, for example, the followings may be described: an alkyl group, an aralkyl group, an alkenyl group, an alkynyl grou, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carbonamido group, a sulfonamido group, a nitro group, an alkylthio group and an arylthio group.

$B_1$ may be linked with the later-mentioned $-(Tm)_t-$ to form a ring. $B_1$ and $B_2$ are most preferably hydrogen atoms.

"Tm" represents a di-valent linking group which may have a timing control function. t represents 0 or 2 When t is 0, PUG (photographic useful group) is directly linked with V. In the present invention, PUG is a residue of development inhibitor.

The di-valent group represented by Tm is a group which releases a PUG from Tm-PUG through one or more reaction steps. Tm-PUG is a group released from the oxidized product of the nucleus of redox compound.

As the di-valent linking group represented by Tm, ones included in the following types of groups can be described; a type of groups, for example, described in U.S. Pat. No. 2,248,962 (JP O.P.I. No. 54-145135/1979), which releases a photographically effective group (PUG) by an intramolecular ring closure reaction such as p-nitrophenoxy derivative; a type of groups such as ones described in U.S. Pat. Nos. 4,310,612 (JP O.P.I. No. 55-53330/1980) and 3,358,252, which releases the PUG by a ring closure reaction after cleavage of the ring; a type of groups described in U.S. Pat. Nos. 4,330,617, 4,446,216 and 4,483,919 and JP O.P.I. No. 59-121328/1984, which releases the PUG by an intramolecular ring closure reaction of a carboxyl group of succinic acid mono-ester or a similar compound accompanied with formation of an acid anhydride; a type of group described in U.S. Pat. Nos. 4,409,323 and 4,421,845, Research Disclosure No. 21,228 (December 1981), U.S. Pat. No. 4,416,977 (JP O.P.I. No. 57-135944/1982), JP O.P.I. Nos. 58-209736/1983 and 58-209738/1983, which releases the PUG by electron transfer through a double bond conjugated with an aryloxy group or a heterocyclic oxy group accompanied with formation of quinomonomethane or a compound similar thereto; a type of groups described in U.S. Pat. No. 4,420,554 (JP O.P.I. No. 57-136640/1982), JP O.P.I. Nos. 57-135945/1982, 57-188035/1982, 58-98728/1983 and 58-209737/1983, which releases the PUG from the g-position of enamine by electron transfer in a moiety having an enamine structure of a nitrogen-containing heterocyclic ring; a type of groups described in JP O.P.I. No. 57-56837/1982, each of which releases the PUG by an intramolecular ring closure reaction of an oxy group formed by electron transfer to the carbonyl group conjugated to the nitrogen atom of a heterocyclic group; a type of groups described in U.S. Pat. 4,146,396 (JP O.P.I. No. 52-90932/1977) and JP O.P.I. Nos. 59-93442/1984 and 59-75475/1984, which releases the PUG accompanied with formation of an aldehyde; a type of groups described in JP O.P.I. Nos. 51-146828/1976, 57-179842/1982 and 59-104641/1984, which releases the PUG accompanied with decarbonation of a carboxyl group; a type of groups having an $—O—COOCR_aR_b—PUG$ structure which releases the PUG by a decarboxylation followed by an aldehyde formation $R_a$ and $R_b$ are each a mono-valent organic group; a type of group described in JP O.P.I. No. 60-7429/1985, which releases the PUG accompanied with formation of an isocyanate; and a type of group described in U.S. Patent, which relates the PUG by a coupling reaction with the oxidation product of a color developing agent.

Concrete examples of the divalent group represented by Tm are also described in JP O.P.I. No. 61-236549/1986 and JP Application No. 63-98803/1988. Preferred examples of group represented by Tm are as follows:

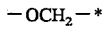

Tm-1

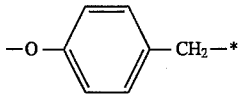

Tm-2

-continued
Tm-3
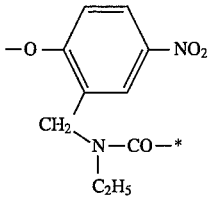
Tm-4
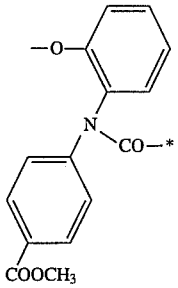
Tm-5
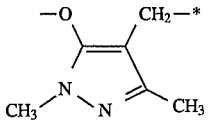
Tm-6
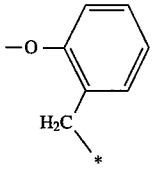
Tm-7
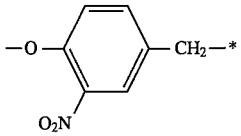
Tm-8
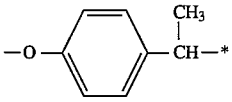
Tm-9
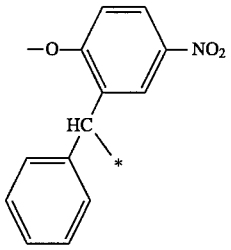
Tm-10
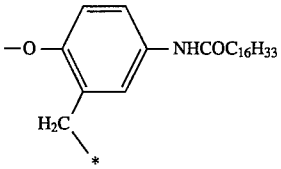
Tm-11
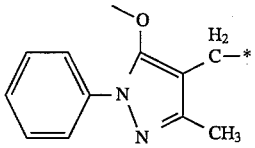
-continued
Tm-12
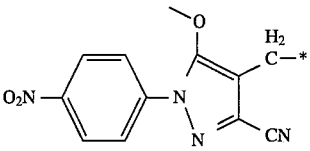
Tm-13
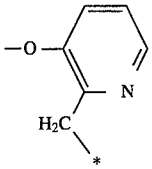
Tm-14
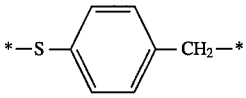
Tm-15
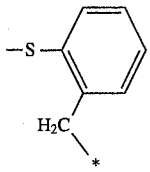
Tm-16
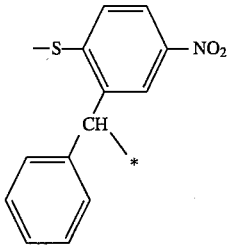
Tm-17
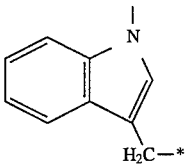
Tm-18
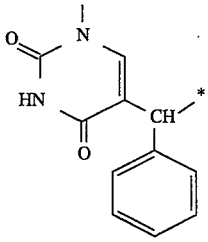
Tm-19
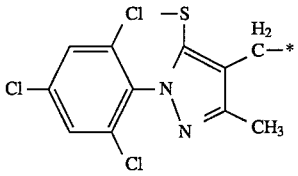
Tm-20
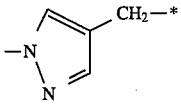
n = 0
Tm-21
*: Portion bonding with PUG Typical examples of developing inhibitor residue represented by PUG, include a residue of mercaptotetrazole, mercaptotriazole, mercaptoimidazole, mercaptopyrimidine, mercaptobenzimidazole, mercaptothiadiazole, mercaptobenzimidazole, mercaptobenzthiazole, mercaptobenzoxazole, benzotriazol, benzimidazole, indazole, tetrazole, tetraazaindene and mercaptoaryl, these residues each may have a substituent usually incorporated in a development inhibitor.

Preferred examples of the residue of development inhibitor represented by PUG are as follows:

1

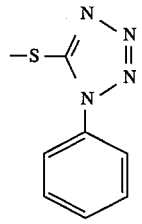

2

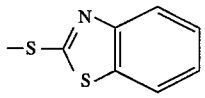

3

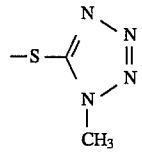

4

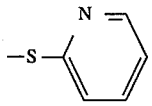

5

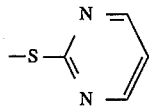

6

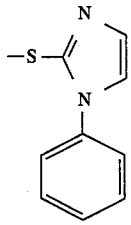

7

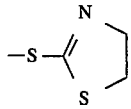

8

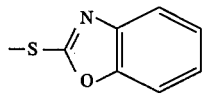

-continued

9

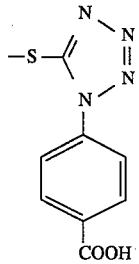

10

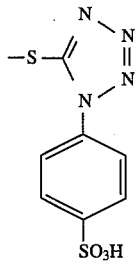

11

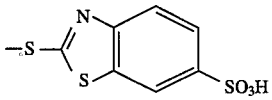

12

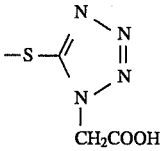

13

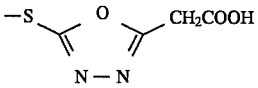

14

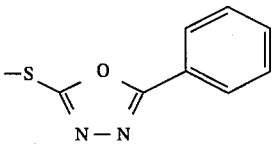

15

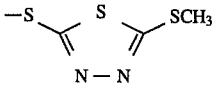

16

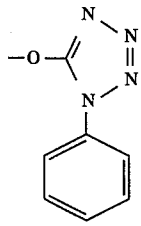

17

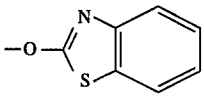

18

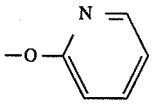

-continued

19

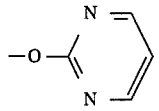

20

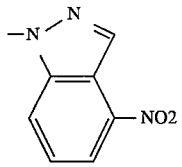

21

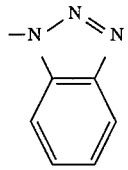

22

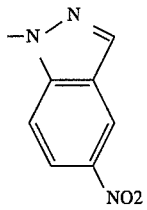

23

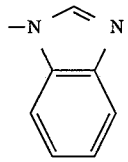

24

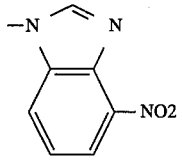

25

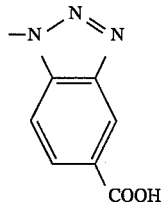

26

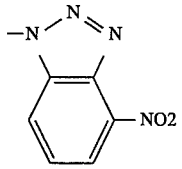

27

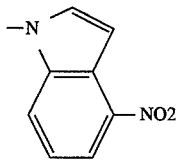

28

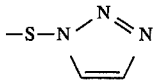

-continued

29

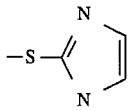

30

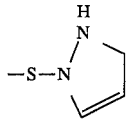

31

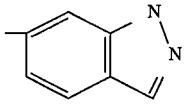

32

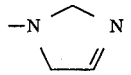

33

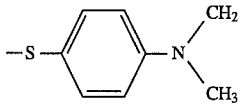

34

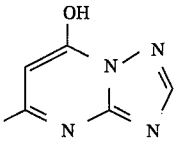

V represents a —C(O)C(O)— group, a sulfonyl group, a sulfoxy group, a —P(O)—$R_1$ group in which $R_1$ is an alkoxyl group or an aryloxy group, an iminomethylene group or a thiocarbonyl group. Among them, carbonyl group is preferable.

An aliphatic group represented by R in Formula R is a straight-, branched- or cyclic alkyl group, an alkenyl group, or an alkynyl group. Preferable number of carbon atom in the aliphatic group is 1 to 30, and 1 to 20 is more preferable. The cyclic alkyl group includes one making a saturated heterocyclic group containing one or more hetero atoms.

As examples of the aliphatic group, a methyl group, t-butyl group, n-octyl group, t-octyl group, cyclohexyl group, hexenyl group, pyrrolidyl group, tetrahydrofulyl group and n-dodecyl group are cited.

The aromatic group is an aryl group having a single ring or two rings such as a phenyl group or a naphthyl group.

The heterocyclic group is a three- to ten-member saturated or unsaturated heterocyclic group containing at least one atom selected from N, O and S atoms. The heterocyclic group may be a single ring group or that condensed with another aromatic ring or heterocyclic ring. Preferable heterocyclic rings are 5- and 6-member heterocyclic rings such as a pyridine ring, imidazolyl group, quinolinyl group, benzoimidazolyl group, pyrimidinyl group, pyrazolyl group, isoquinolynyl group, benzothiazolyl group and thiazolyl group.

The group represented by R may have a substituent such as those described below.

Examples of the substituent are an alkyl group, an aralkyl group, an alkenyl group, an alkynyl group, an alkoxy group, an aryl group, an amino group, an alkyl amino group, an acylamino group, a sulfonylamino group, a ureido group, a urethane group, an aryloxy group, a sulfamoyl group, a carbamoyl group, an alkylthio group, an arylthio group, a sulfothio group, a sulfinyl group, a hydroxyl group, a halogen atom, a cyano group, a sulfo group, an alkoxycarbonyl group, an aryloxycarbonyl group, an acyl group, an acyloxy group, a carbonamido group, a sulfonamido group, and a phosphoric acid amido group. The above substituents further may have a substituent which are the same as above.

The group represented by R and —$(Tm)_t$—PUG in Formula R each preferaably has a ballast group usually used in an immobilized photographic additives such as a coupler or a group which accelerates absorption of a compound represented by Formula R-I to silver halide.

The ballast group is an organic group providing a sufficient molecular weight to the compound represented by R for preventing diffusion of the compound into another layer or a processing solution. The ballast group are, for example, a photographically inactive group such as an alkyl group, an aryl group, a heterocyclic group, an ether group, a thioether group, an amido group, a ureido group, a urethane group and a sulfonamido group each having 8 or more carbon atoms, these groups may be used singly or in combination. As the ballast group, a group having a substituted benzene ring is preferable, particularly a group having a benzene ring substituted by a blanched alkyl group is preferable.

Concrete examples of the groups accelerating absorption to silver halide are as follows: a cyclic thioamido group such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine or 1,3-imidazoline-2-thion; a chain thioamido group, an aliphatic mercapto group; an aromatic mercapto group; a heterocyclic mercapto group (which is synonymous with a isomeric cyclic thioamido group when the atom adjacent to the carbon atoms on which the mercapto group is bonded, is a nitrogen atom, the examples of the group is the same as the above-mentioned group); a group having a disulfide bonding; 5- or 6-member nitrogen-containing heterocyclic group composed of a combination of nitrogen, oxygen, sulfur and carbon atoms; and a heterocyclic quartenary ammonium salt such as benzimidazolium.

The above groups may be substituted with a substituent such as those represented by R.

Examples of the compound usable in the invention are listed below. However the invention is not limited thereto.

R-1

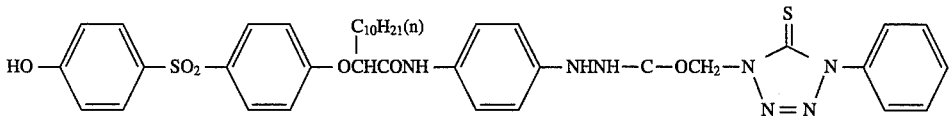

R-2

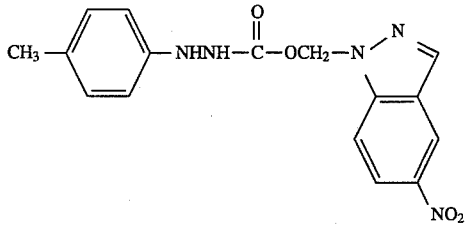

R-3

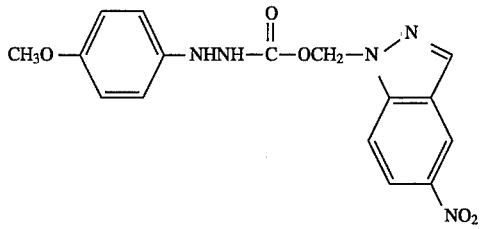

R-4

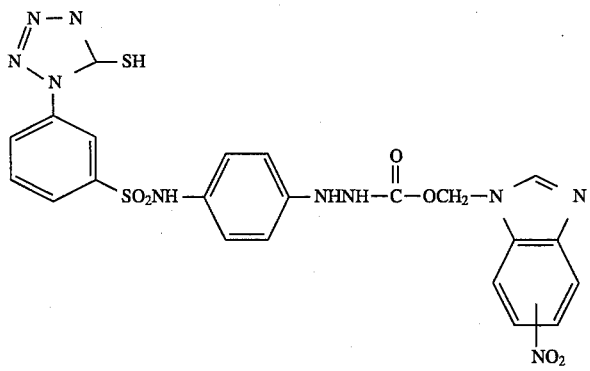

-continued
R-5
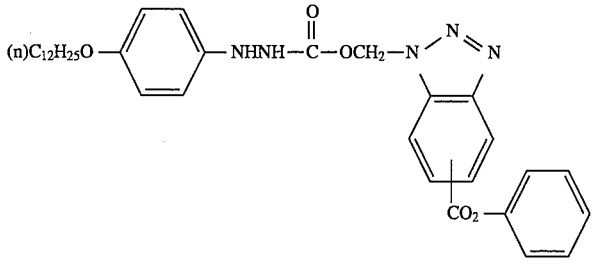
R-6
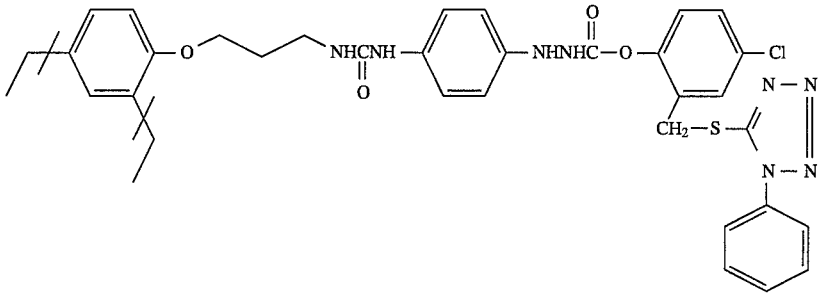
R-7
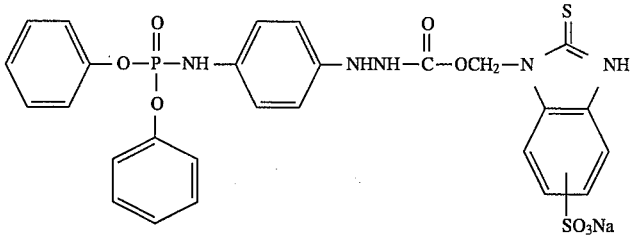
R-8
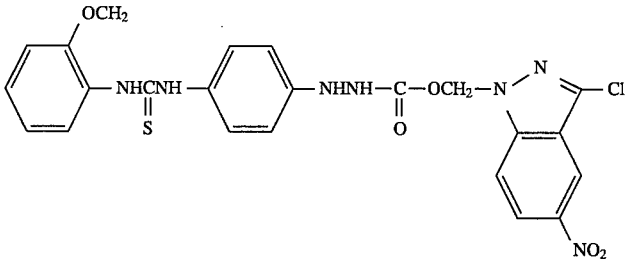
R-9
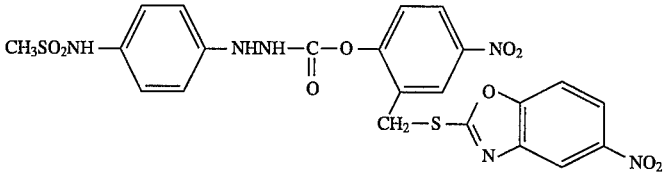
R-10
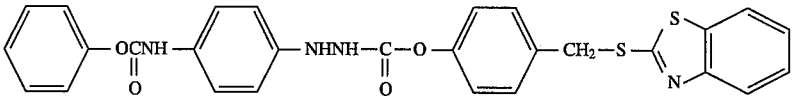

-continued
R-11
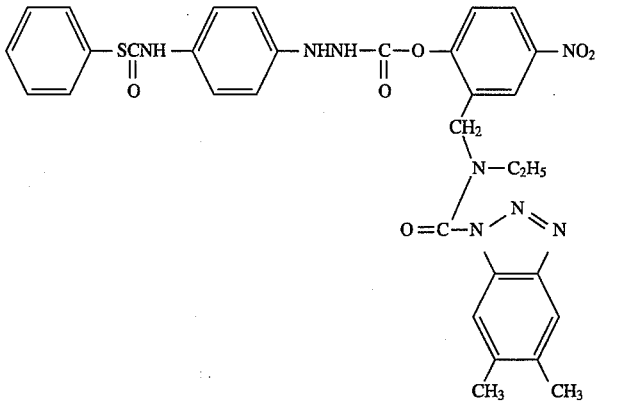
R-12
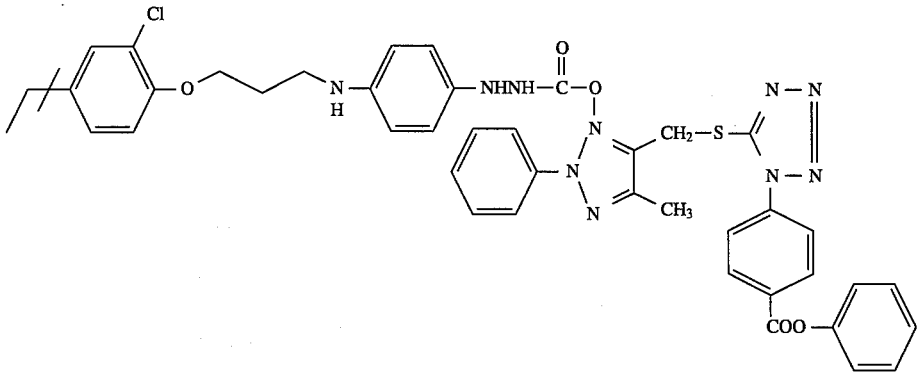
R-13
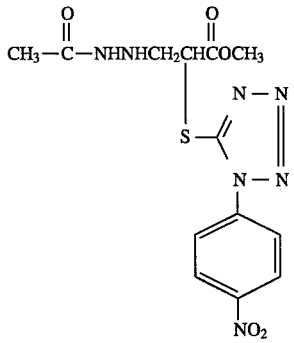
R-14
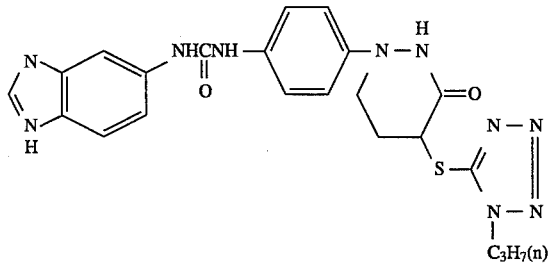
R-15
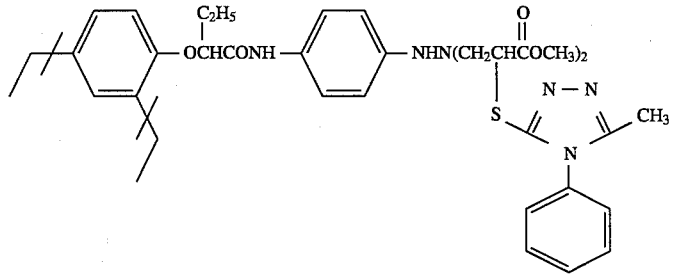

-continued
R-16
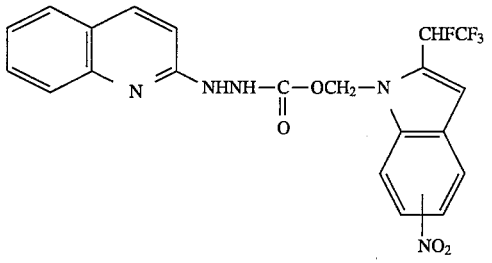
R-17
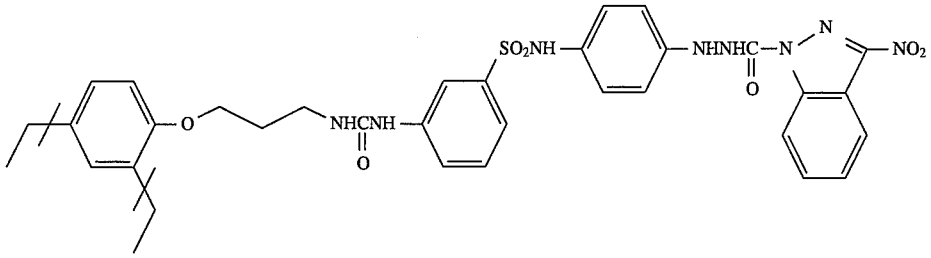
R-18
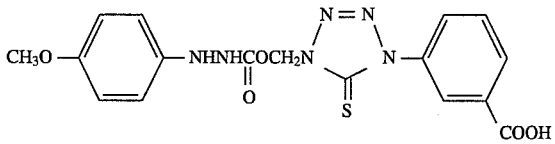
R-19
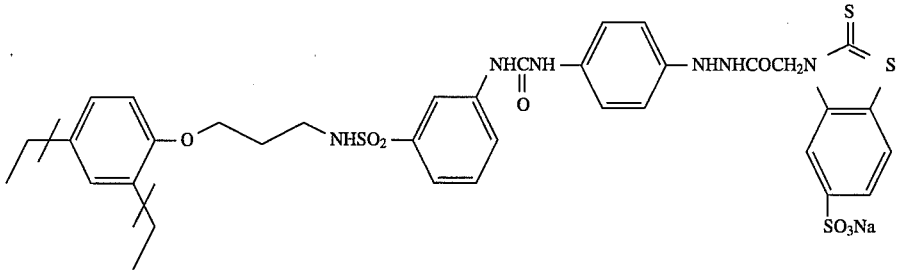
R-20
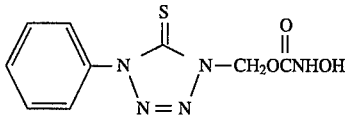
R-21
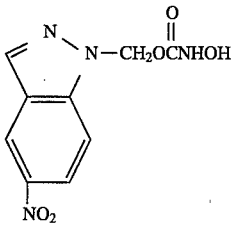
R-22
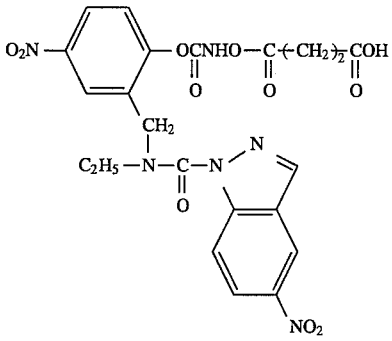

-continued
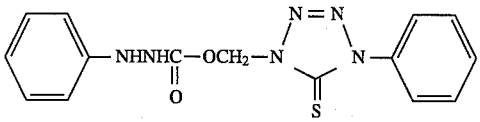
R-23
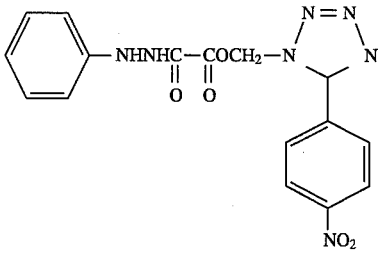
R-24
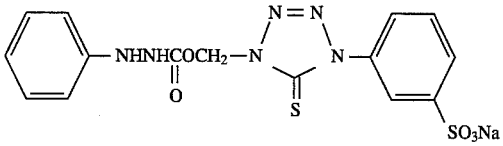
R-25
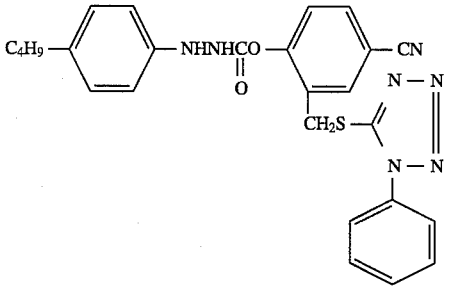
R-26
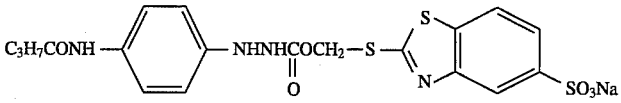
R-27
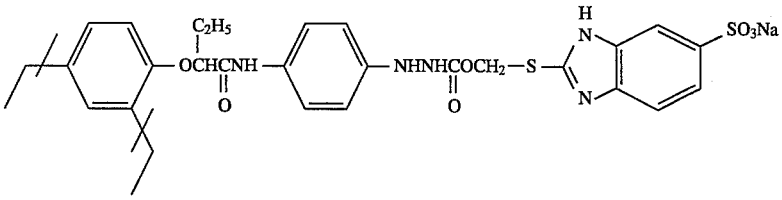
R-28
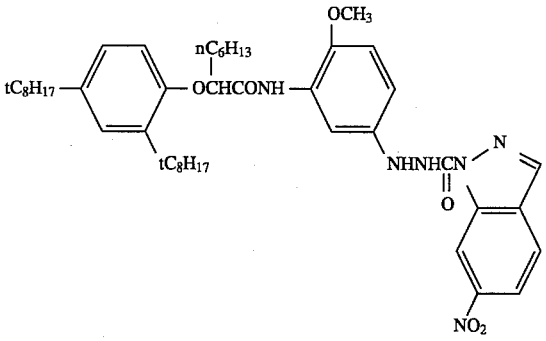
R-29

-continued
R-30
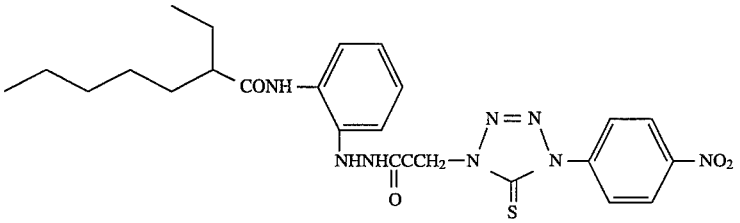
R-31
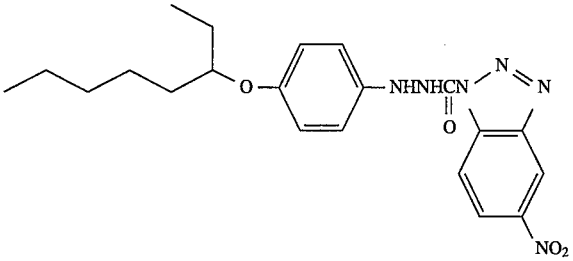
R-32
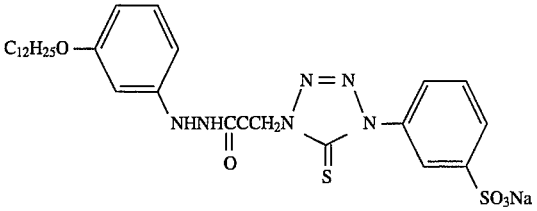
R-33
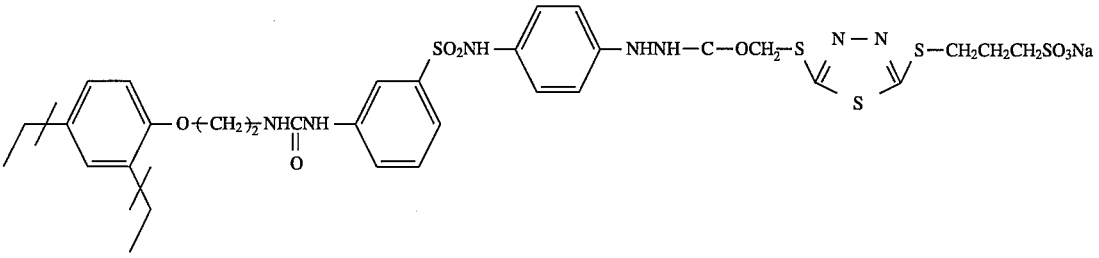
R-34
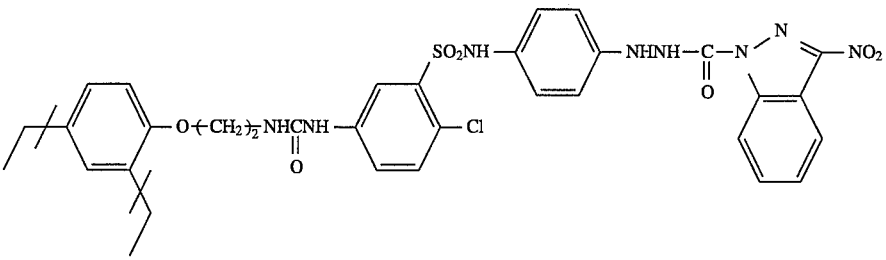
R-35
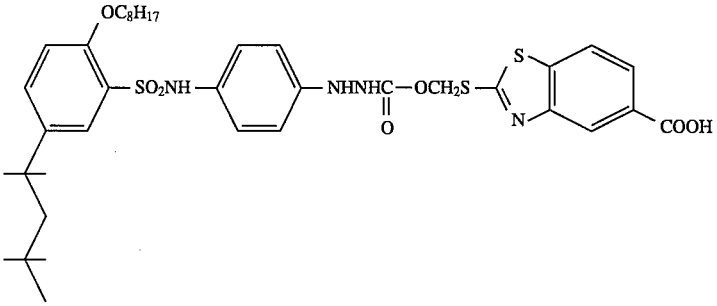

-continued
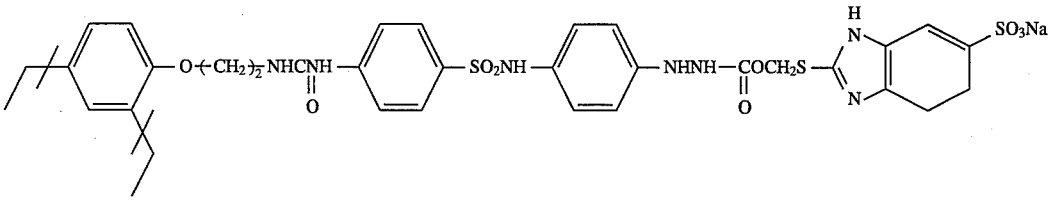
R-36
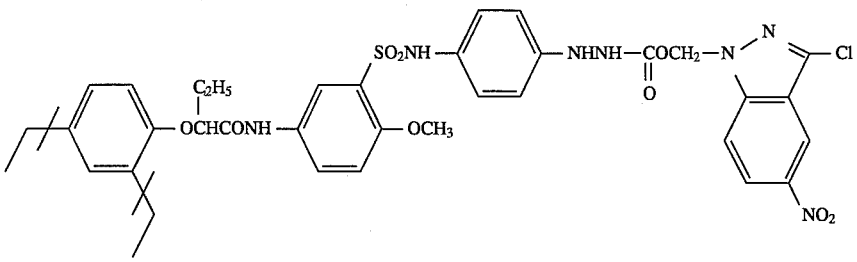
R-37
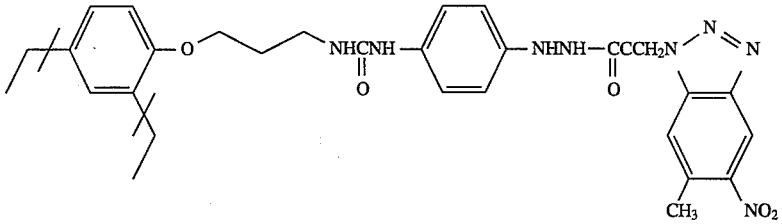
R-38
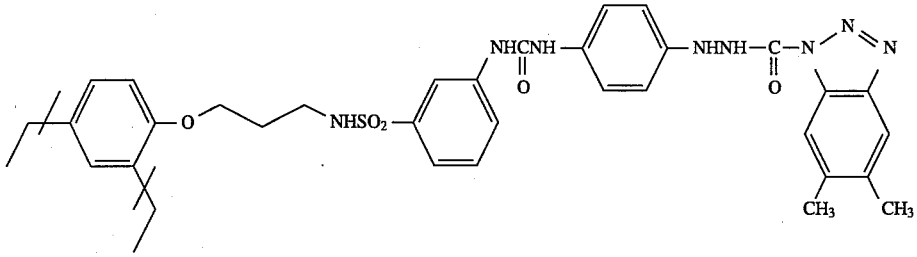
R-39
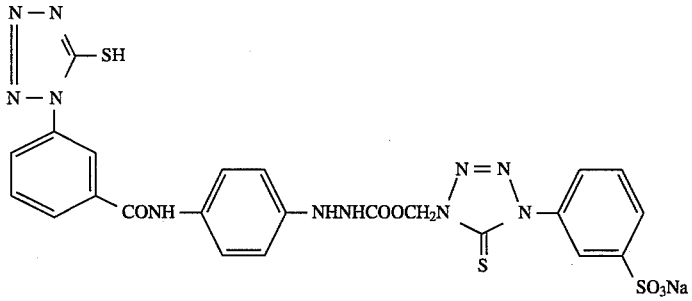
R-40
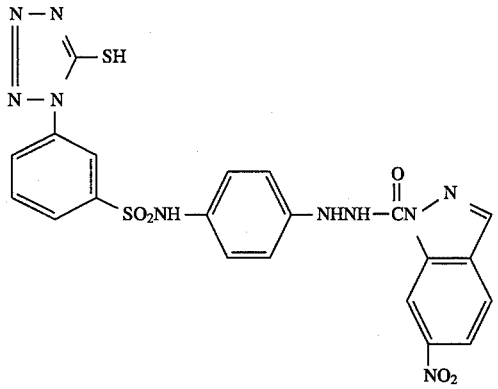
R-41

-continued
R-42
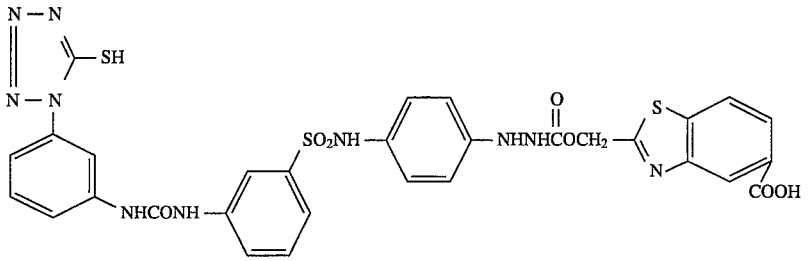
R-43
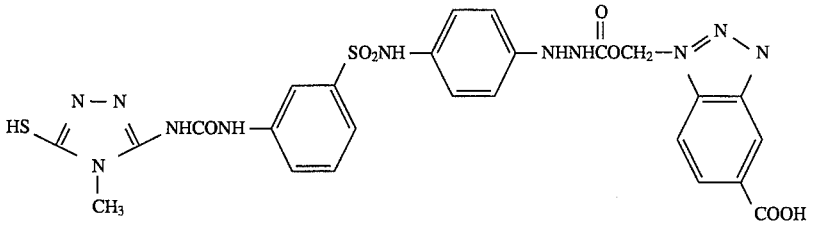
R-44
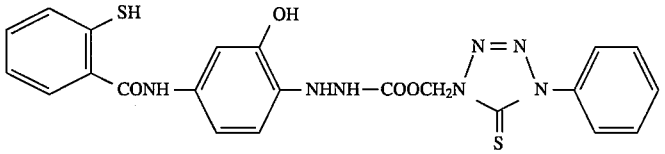
R-45
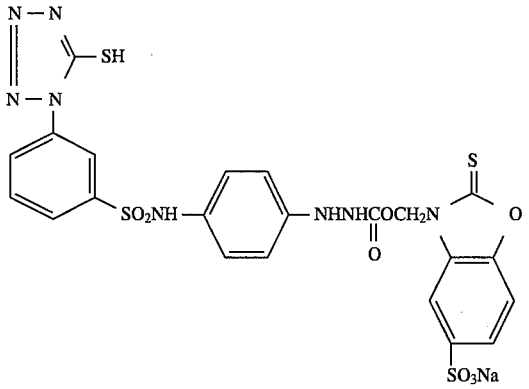
R-46
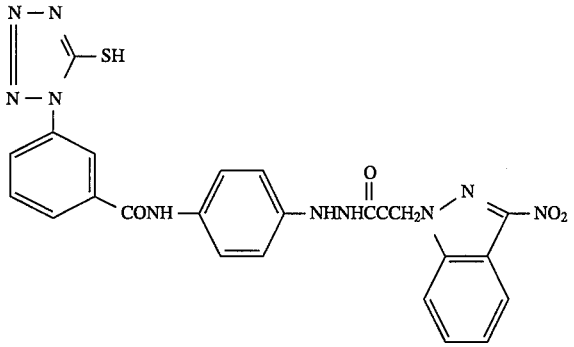
R-47
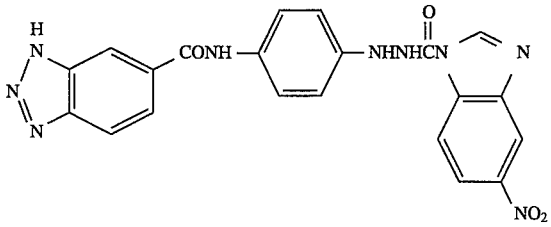

-continued

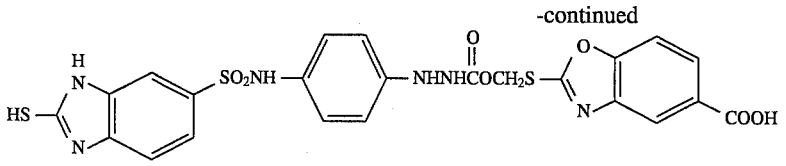

R-48

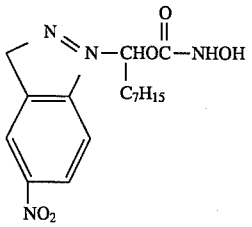

R-49

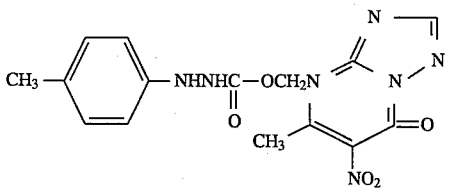

R-50

Synthesis methods of the redox compounds usable in the invention are described in, for example, JP O.P.I. Nos. 61-213847/1986 and 62-260153/1987, U.S. Pat. No. 4,684,604, JP O.P.I. No. 1-269936/1989, U.S. Pat. Nos. 3,379,529, 3,620,746, 4,377,634 and 4,332,878 and JP O.P.I. Nos. 49-129536/1974, 56-153336/1981 and 56-153342/1081.

Another kind of preferred redox compound usable in the invention is one represented by the following Formula R-II, R-III, R-IV , R-V, R-VI or R-VII.

In the above Formulas R-II through R-VII, $R_1$ is an alkyl group or a heterocyclic group. $R_2$ and $R_3$ is a hydrogen atom, an acyl group, a carbamoyl group, a cyano group, a nitro group, a sulfonyl group, an aryl group, an oxaryl group, a heterocyclic group, an alkoxycarbonyl group or an aryloxycarbonyl group. $R_4$ is a hydrogen atom. $R_5$, $R_6$, $R_7$, $R_8$ and $R_9$ are each a hydrogen atom, an alkyl group, an aryl group or a heterocyclic group. $r_1$, $r_2$ and $r_3$ are each a group capable of being a substituent of the benzene ring. $X_1$ and $X_2$ are each O or NH. W is $N(R_{10})R_{11}$ or OH in which $R_{10}$ and $R_{11}$ are each a hydrogen atom, an alkyl group, an aryl group or a heterocyclic group.

COUP is a coupler residue capable of coupling with the oxidation product of an aromatic primary amine color developing agent. and "H" represents the coupling position of the coupler. Tm is a timing group. $m_1$ and $p_1$ are each an integer of 0 to 3. $q_1$ is an integer of 0 to 4 and n is 0 or 1. PUG is a residue of a development inhibitor.

As alkyl group, aryl group and heterocyclic group represented by $R_1$ and $R_5$ to $R_{11}$, methyl group, p-methoxy group and pyridyl group are preferable. Among the group represented by $R_2$ and $R_3$, an acyl group, carbamoyl group and cyano group are preferred. Number of carbon atom in these groups is preferably 1 to 20. Groups represented by $R_1$ through $R_{11}$ each may have a substituent. The substituent includes, for example, a halogen atom such as chlorine atom or bromine atom, an alkyl group such as methyl, ethyl, iso-propyl, hydroxyethyl, methoxymethyl, trifluoromethyl or t-butyl, a cycloalkyl group such as cyclopentyl or cyclohexyl, an aralkyl group such as benzyl or 2-phenetyl, an aryl group such as phenyl, naphthyl, p-tolyl or p-chlorophenyl, an alkoxy group such as methoxy, ethoxy, iso-propoxy or butoxy, an aryloxy group such as phenoxy, a cyano group, an acylamino group such as acetylamino or propionylamino, an alkylthio group such as metylthio, ethylthio or butylthio, an arylthio group such as phenylthio, a sulfonylamino group such as methanesulfonylamino or benzenesulfonylamino, a ureido group such as 3-methylureido, 3,3-dimethylureido or 1,3-dimethylureido, a sulfamoylamino group such as dimethylsulfamoyl, a carbamoyl group such as methylcarbamoyl, ethylcarbamoyl or dimethylcarbamoyl, a sulfamoyl group such as ethylsulfamoyl or dimethylsulfamoyl, an alkoxycarbonyl group such as metboxycarbonyl or ethoxycarbonyl, an arylcarbonyl group such as phenoxycarbonyl, a sulfonyl group such as methanesulfonyl, butanesulfonyl or phenylsulfonyl, an acyl group such as acetyl, propanoyl or butyloyl, an amino group such as methylamino, ethylamino or dimethylamino, a hydroxyl group, a nitro group, an imido group such as phthalimido, or a heterocyclic group such as pyridyl, benzimidazolyl, benzothiazolyl or banzoxazolyl. A heterocyclic ring represented by $Z_1$ is a 5- or 6-member heterocyclic ring having at least one of O, S and N atoms therein. The heterocyclic ring may be a single ring or a condensed ring and the ring may have a substituent. As the substituent, those described the above are applicable.

Coupler residues represented by COUP are described below. Cyan coupler residues include phenol coupler residues and naphthol coupler residues. Magenta coupler residues include 5-pyrazolone coupler residues, pyrazolone coupler residue and acetylcumarone coupler residues, open-chain acylacetonitrile coupler residues and indazolone coupler residues. Yellow coupler residues include benzoylacetoanilide coupler residue, pivaloylacetoanolide coupler residues and malonic acid dianilide coupler residues. Non color forming coupler residues include open-chain or cyclic active methylene compounds such as indanone, cyclopentanone, diester of malonic acid, imidazolinone, oxazolinone and thiazolinone. Among the coupler residues represented by COUP, those represented by Formula Coup-1 to Coup-7 or Coup-8 are preferred.

Formula Coup-1

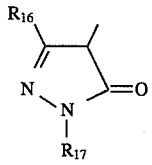

In the formula, $R_{16}$ is an acylamido group, anilino group or a ureido group; and $R_{17}$ is a phenyl group which may be substituted one or more of halogen atoms, alkyl groups, alkoxy group or cyano groups.

Formula Coup-2

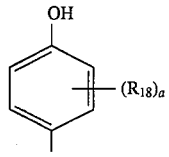

Formula Coup-3

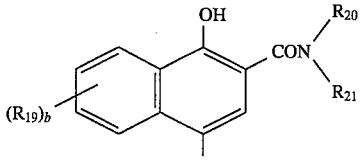

In the formulas, $R_{18}$ and $R_{19}$ are each a halogen atom, an acylamido group, an alkoxycarbonylamido group, a sulfoureido group, an alkoxy group, an alkylthio group, a hydroxy group or an aliphatic group; $R_{20}$ and $R_{21}$ are each an aliphatic group, an aromatic group or a heterocyclic group and one of which may be a hydrogen atom; a is an integer of 1 to 4; and b is an integer of 0 to 5; when a or b are each 2 or more, each of $R_{18}$'s or $R_{19}$'s are the same or different, respectively.

Formula Coup-4

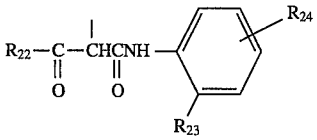

Formula Coup-5

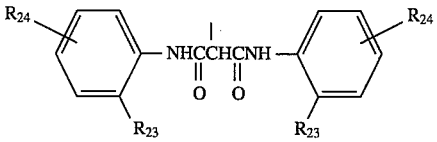

In the formulas, $R_{22}$ is a tertiary alkyl group or an aromatic group; and $R_{23}$ is an acylamido group, an aliphatic group, an alkoxycarbonyl group, a sulfamoyl group, carbamoyl group, an alkoxy group, a halogen atom or a sulfonamido group.

Formula Coup-6

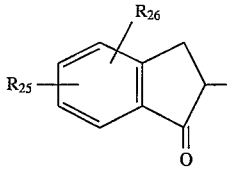

In the formula, $R_{25}$ is an aliphatic group, an alkoxy group, an acylamino group, a sulfonamido group, a sulfamoyl group or a diacylamino group; and $R_{26}$ is a hydrogen atom, a halogen atom or a nitro group.

Formula Coup-7

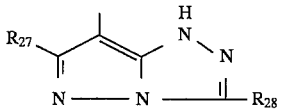

Formula Coup-8

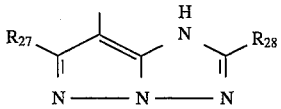

In the formulas, $R_{27}$ and $R_{28}$ are each a hydrogen atom, an aliphatic group, an aromatic group or a heterocyclic group.

In Formula II to VII, timing group represented by Tm is the same as that described as to Formula I.

Although examples of the compound represented by Formula II to VII are shown below, the invention is not limited thereto.

| Compound | Tm | PUG |
|---|---|---|
| | 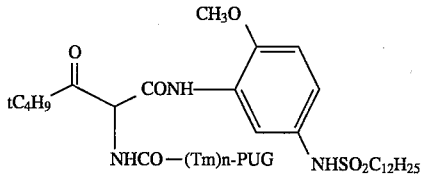 | |
| R-51 | 1 | 1 |
| R-52 | 2 | 4 |
| R-53 | 4 | 14 |
| R-54 | 17 | 17 |
| R-55 | 21 | 22 |
| | 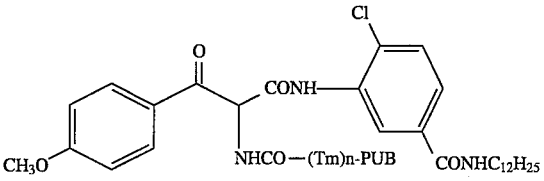 | |
| R-56 | 6 | 2 |
| R-57 | 3 | 6 |
| R-58 | 6 | 10 |
| R-59 | 11 | 13 |
| R-60 | 20 | 24 |

-continued
| Compound | Tm | PUG |
|---|---|---|
| 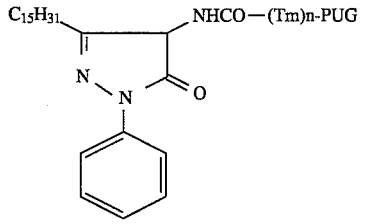 | | |
| R-61 | 1 | 1 |
| R-62 | 2 | 5 |
| R-63 | 5 | 2 |
| R-64 | 6 | 15 |
| R-65 | 17 | 3 |
| 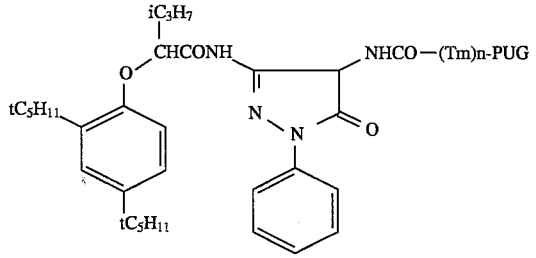 | | |
| R-66 | 1 | 1 |
| R-67 | 2 | 1 |
| R-68 | 2 | 4 |
| R-69 | 2 | 5 |
| R-70 | 6 | 2 |
| R-71 | 8 | 5 |
| R-72 | 8 | 1 |
| R-73 | 18 | 22 |
| R-74 | 20 | 2 |
| R-75 | 21 | 20 |
| 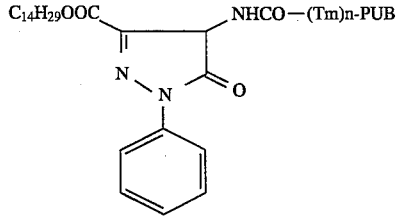 | | |
| R-76 | 2 | 4 |
| R-77 | 4 | 8 |
| R-78 | 12 | 9 |
| R-79 | 13 | 12 |
| R-80 | 16 | 16 |
| 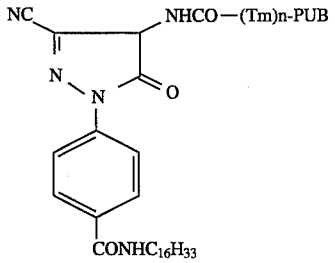 | | |
| R-81 | 2 | 3 |
| R-82 | 7 | 7 |
| R-83 | 8 | 11 |
| R-84 | 14 | 14 |
| R-85 | 19 | 18 |

-continued
| Compound | Tm | PUG |
|---|---|---|
| 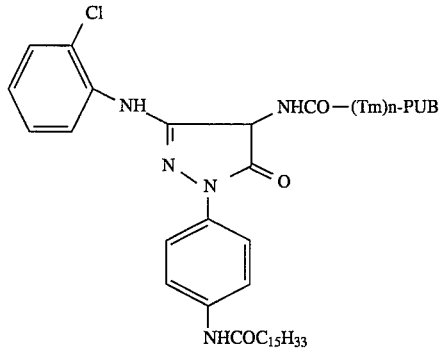 | | |
| R-86 | 2 | 2 |
| R-87 | 5 | 8 |
| R-88 | 9 | 18 |
| R-89 | 10 | 21 |
| R-90 | 19 | 27 |
| 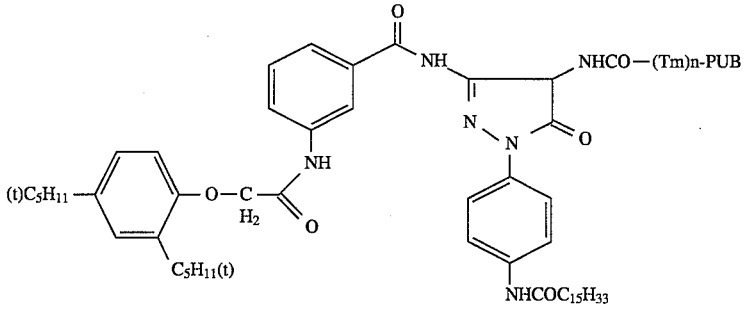 | | |
| R-91 | 2 | 4 |
| R-92 | 2 | 5 |
| R-93 | 5 | 15 |
| R-94 | 6 | 6 |
| R-95 | 21 | 26 |
| 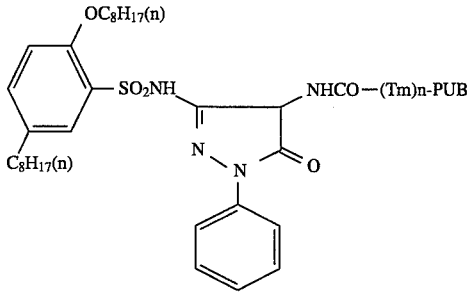 | | |
| R-96 | 2 | 4 |
| R-97 | 8 | 5 |
| R-98 | 8 | 1 |
| R-99 | 1 | 15 |
| R-100 | 17 | 18 |
| 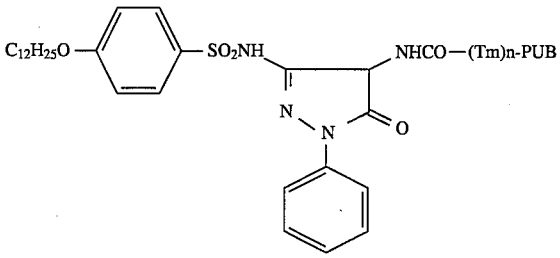 | | |

-continued

| Compound | Tm | PUG |
|---|---|---|
| R-101 | 2 | 4 |
| R-102 | 8 | 5 |
| R-103 | 8 | 1 |
| R-104 | 1 | 20 |
| R-105 | 14 | 23 |

In the invention, the redox compound is used in an amount of $1.0\times10^{-6}$ moles to $5.0\times10^{-2}$ moles, preferably $1.0\times10^{-5}$ moles to $1.0\times10^{-2}$ moles, per mole of silver. The redox compound usable in the invention can be used in a form of solution dissolved in a water-permeable organic solvent, for example, an alcohol such as methanol, ethanol, propanol and fluorinated alcohol; a ketone such as acetone and methyl ethyl ketone; dimethylformamide, dimethylsulfoxide or methyl cellosolve.

The redox compound can be used as a dispersion prepared by a well-known emulsifying dispersion method in which the compound is dissolved in an oil such as dibutyl phthalate, tricresyl phosphate, glycelol triacetate or diethyl phthalate with a assistant solvent such as ethyl acetate or cyclohexanone and mechanically dispersed in an aquous mdium. The compound is used also by a method known as solid dispersion method in which powder of the redox compound is dispersed in water by making use of a ball mill, colloid mill or ultrasonic vibration.

A layer containing the redox compound of the invention is preferably provided at a position farther from the support than the layer containing a hydrazine compound. The layer containing the redox compound may further contains light-sensitive or non-light-sensitive silver halide grains. The light-sensitive material further may have a supplemental light-sensitive layer containing no hydrazine compound. An interlayer comprised of gelatin or a synthetic polymer such as polyvinyl acetate or polyvinyl alcohol may be provided between the layer containing the hydrazine compound and the light-sensitive emulsion layer.

To the silver halide emulsion to be used in the light-sensiitve material in the invention, usually known chemical sensitization such as a sulfur sensitization, Se sensitization, Te sensitization and reduction sensitization can be optionally applied. An emulsion without chemical sensitization is also can be used. As the sulfur sensitizer, a sulfur compounds contained in gelatin and various sulfur compound such as thiosulfates, thioureas, rhodanines, polysulfides are usable. As the selenium sensitizer, triphenylphosphine is preferably used. A gold sensitization is a typical method of noble metal sensitizing methods, in which a gold complex salt is mainly used. A noble metal other than gold such as a complex salt of platinum, palladium or rhodium may also be contained.

A stannous salt, amine compound, formamidinesulfonic acid, silane compound can be used as the reducing sensitizer.

In the present invention, the composition of silver halide contained in the silver halide emulsion is preferably silver chloride, silver chlorobromide having a silver chloride content of not less than 60 mole % or silver chloroiodobromide having a silver chloride content of not less than 60 mole %.

A preferable average size of the silver halide grains is not more than 0.7 μm, particularly preferable 0.1 to 0.5 μm. "Average size" is a term usually used in the field of photographic science and is easily understood by one skilled in the field. In the case of spherical or approximate spherical grains, "grain size" means diameter of grain. When the grain is cubic, "grain size" is diameter of sphere converted from the cube. As to detail of determining method of average grain size, C. E. Mees & T. H. James, "The Theory of the Photographic Process", Vol. 3, P.P. 36–43, Mcmillan 1966, can be referred.

As the procedure for reacting a water soluble silver salt and a water soluble halide salt, any of single-jet mixing method, double-jet mixing method and combination thereof may be used.

A method in which silver halide grains are formed in the presence of excess silver ions, so called reverse mixing method, is also may be used. A kind of the double-jet mixing method in which the pAg of the liquid phase, in which silver halide is formed, is maintained at a constant value, so called controlled double-jet method can be used. A silver halide emulsion can be prepared by this method, which contains silver halide grains having regular crystal shape and uniform grain size.

It is preferable to add a salt or complex salt of cadmium, zinc, lead, thallium, iridium, rhodium, ruthenium or osmium to the silver halide grains to be used in the silver halide emulsion at a step for forming or growing the silver halide grains.

Silver halide emulsion and its preparation method are described in detail in Research Disclosure No. 176, 17643, p.p. 22–23, December 1978, and publications cited therein.

In the present invention, a hydrazine compound is contained in the silver halide emulsion layer or a hydrophilic colloid layer adjacent to the emulsion layer of the light-sensitive material as a nulceation agent. As the hydrazine compound in the invention, ones represented by the following Formula H are usable.

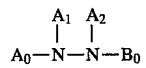

Formula H

Formula H is described in detail below.

In the formula, $A_0$ is an aliphatic group, an aromatic group or a heterocyclic group. A preferable aliphatic group represented by $A_0$ is one having 1 to 30 carbon atoms, particularly a straight, branched or cyclic alkyl group having 1 to 20 carbon atoms such as a methyl group, ethyl group, t-butyl group, octyl group, cyclohexyl group or benzyl group. These groups each may have an appropriate substituent such as an aryl group, alkoxy group, aryloxy group, alkylthio group, arylthio group, sulfoxy group, sulfonamido group, sulfamoyl group, acylamino group or ureido group.

As the aromatic group represented by $A_0$ in Formula [H], a single-ring or condensed-ring aryl group such as a benzene ring or naphthalene ring.

As the heterocyclic group represented by $A_0$ in Formula H, a single or condensed heterocyclic ring which contains at least one hetero-atom selected from nitrogen, sulfur and oxygen, such as a pyrrolidine ring, imidazole ring, tetrahydrofuran ring, morpholine ring, pyridine ring, pyrimidine ring, quinoline ring, thiazole ring, benzothiazole ring, thiophene ring or furan ring.

A preferable group represented by $A_0$ is an aryl group or a heterocyclic group. It is preferable that the aryl group or heterocyclic group represented by $A_0$ to have a substituent. As the preferable substituent, for example, an alkyl group, aralkyl group, an alkenyl group, alkynyl group, alkoxy group, amino group, alkyl amino group, acylamino group, sulfonylamino group, ureido group, urethane group, aryloxy group, sulfamoyl group, carbamoyl group, alkylthio group, arylthio group, sulfothio group, sulfinyl group, hydroxy group, halogen atom, cyano group, sulfo group, aryloxycarbonyl group, acyl group, alkoxycarbonyl group, acyloxy group, carbonamido group, sulfonamido group, carboxy group and phosphoric acid amido group are described. These groups further may have each a substituent. When the processing is performed by making use of a developer having a pH of not more than 10.5 and for a time of not more than 60 seconds in total (dry to dry), a substituent having an acidic group with a pKa value of 7 to 11 is preferable. Example of such substituent includes a sulfonamido group, hydroxy group or mercapto group. A sulfonamido group is particularly preferable.

It is preferable that the group represented by $A_0$ has at least one anti-diffusion group or silver halide adsorption accelerating group. The anti-diffusion groups preferably a group usually used as a ballast group in an immovable photographic additives such as a coupler. As the ballast group, for example, an alkyl group, alkenyl group, alkynyl group, alkoxy group, phenyl group, phenoxy group and alkylphenoxy group are described.

As silver halide adsorption accelerating group, for example, a thiourea group, thiourethane group, mercapto group, thioether group, thione group, heterocyclic group, thioamido heterocyclic group, mercapto heterocyclic group, or group described in JP O.P.I. 64-90439/1989 are described.

$B_0$ represents a blocking group, preferably a —$G_0$—$D_0$ group, in which $G_0$ is a —CO— group, —COCO— group, —CS—group, —C(=$NG_1D_1$)— group, —SO— group, —$SO_2$— group or —P(O)($G_1D_1$)— group. $G_1$ is a simple linkage, such as —O—, —S— or —N($D_1$)— group. $D_1$ is an aliphatic group, aromatic group, heterocyclic group or hydrogen atom, when a plurality of $D_1$ is present, they may be the same or different.

$D_0$ represents an aliphatic group, an aromatic group, a heterocyclic group, amino group, alkoxy group, or mercapto group.

As $G_0$, the —CO— group or —COCO— group are preferable, and the —COCO— group is particularly preferable.

Preferable group represented by DO includes a hydrogen atom, alkoxy group and amino group.

One of $A_1$ and $A_2$ is a hydrogen atom and another one of them is a hydrogen atom or an acyl group, such as an acetyl group, trifluoroacetyl group or benzoyl group; a sulfonyl group such as a methanesulfonyl group or toluenesulfonyl group; or an oxalyl group such as ethoxalyl group.

Concrete examples of the compound represented by Formula [H] are described below. However the invention is not limited thereto.

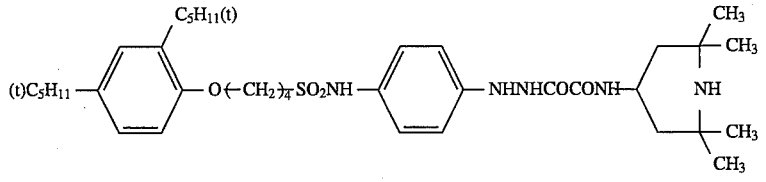

H-1

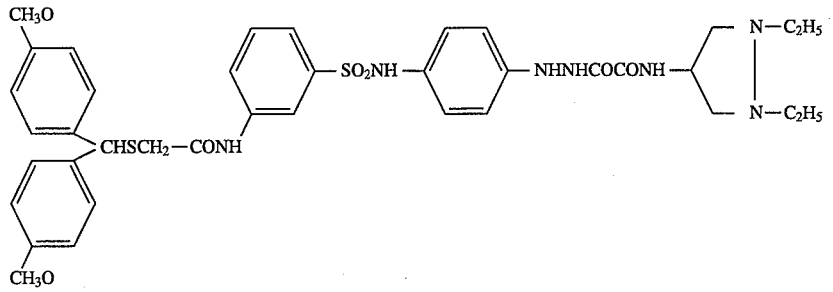

H-2

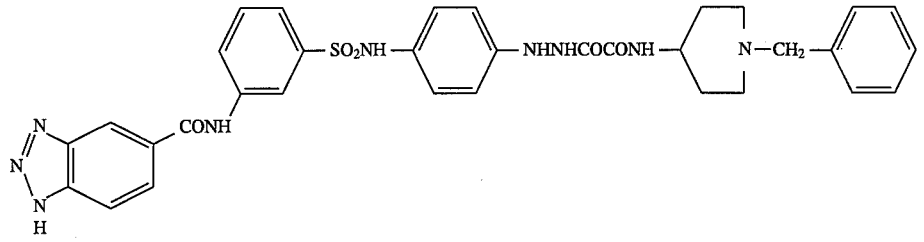

H-3

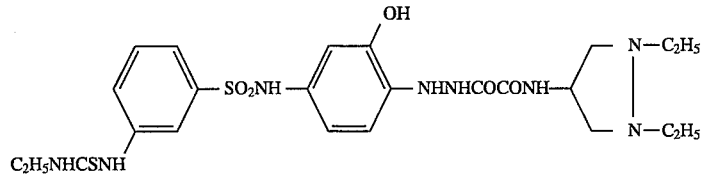

H-4

-continued
H-5
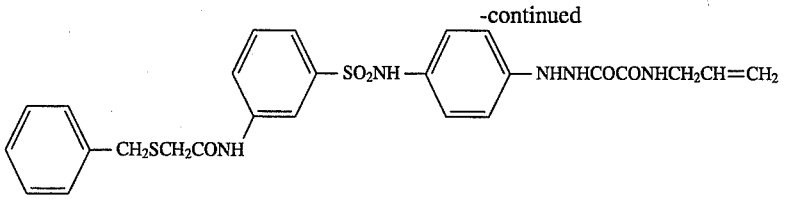
H-6
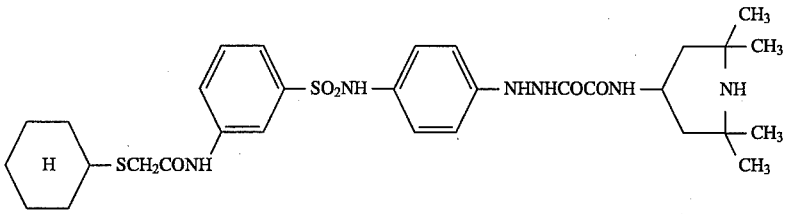
H-7
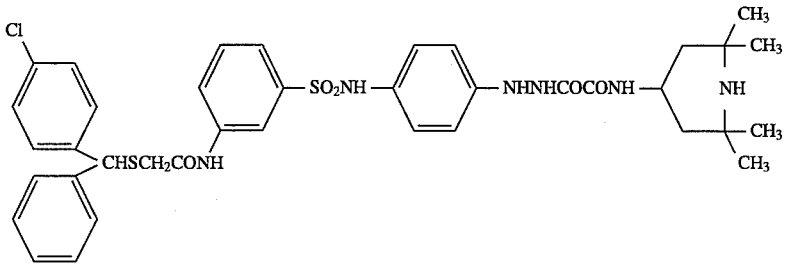
H-8
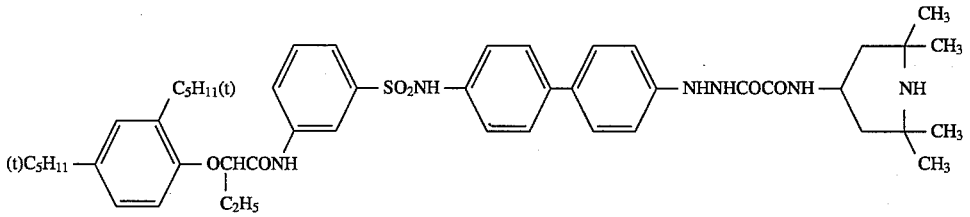
H-9
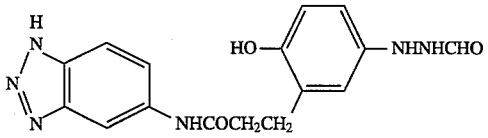
H-10
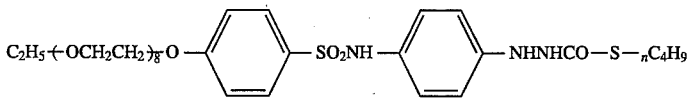
H-11
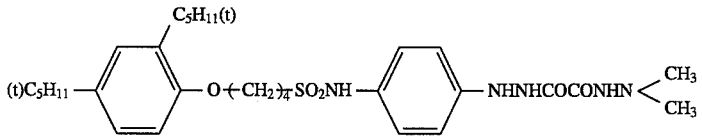
H-12
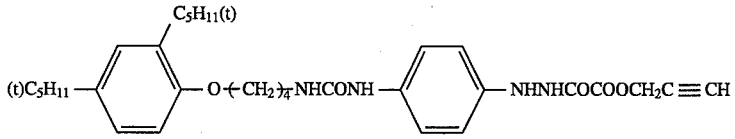
H-13
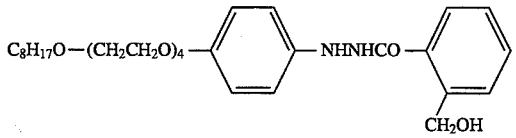

-continued
H-14
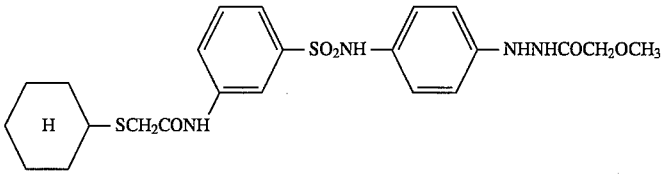
H-15
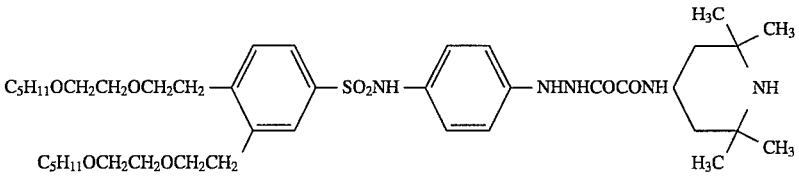
H-16
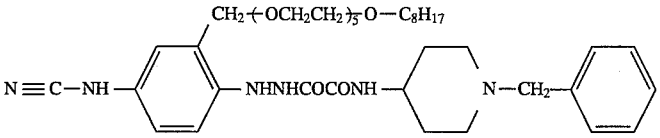
H-17
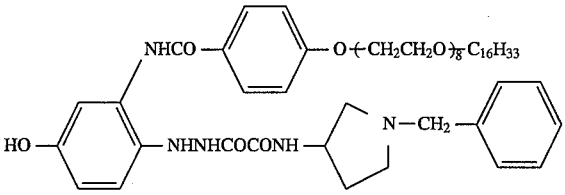
H-18
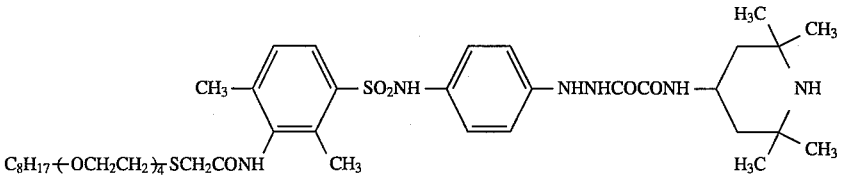
H-19
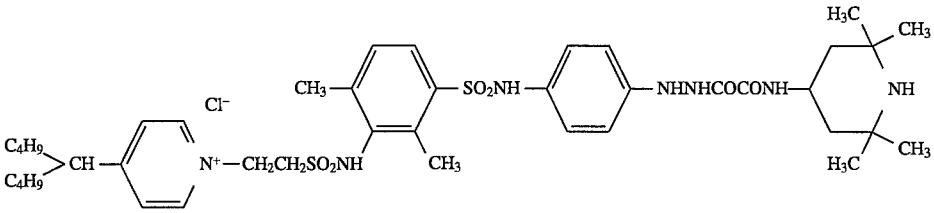
H-20
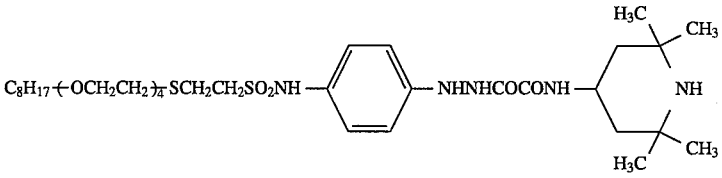
H-21
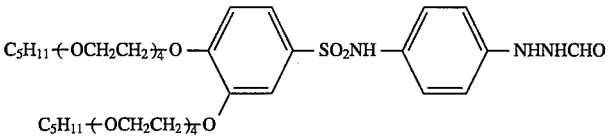
H-22
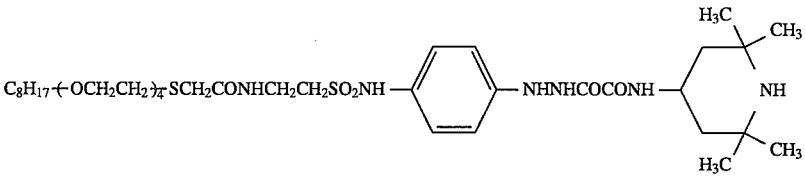

-continued

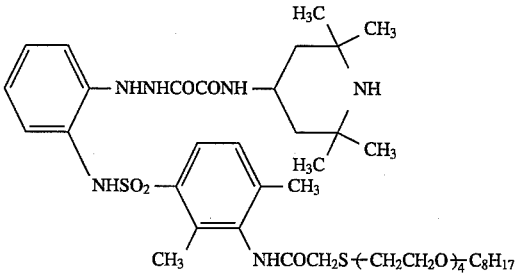

H-23

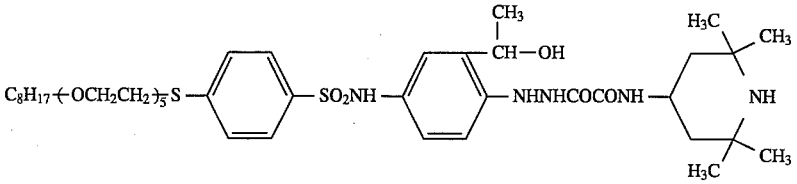

H-24

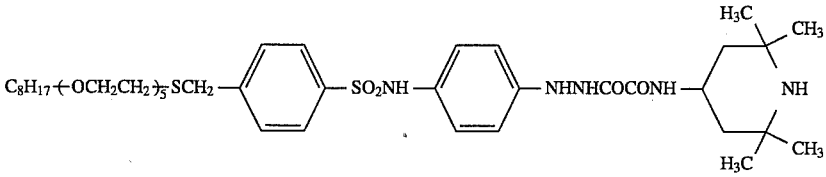

H-25

The above-mentioned hydrazine compound is preferably used in an amount of $1\times10^{-5}$ to $1\times10^{-2}$, more preferably $5\times10^{-5}$ to $5\times10^{-3}$ moles/mole of silver.

In the invention, a nucleation accelerating agent represented by the following Formula Na or Nb is preferably used to enhance the high contrast effect of the hydrazine compound.

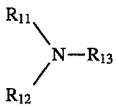

Formula [Na]

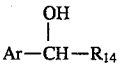

Formula [Nb]

In Formula N-a, $R_{11}$, $R_{12}$ and $R_{13}$ are each independently a hydrogen atom, an alkyl group, an alkenyl group, an alkynyl group or an aryl group. The above alkyl group, alkenyl group and aryl group each may have a substituent. Substituents suitable to the above groups are the same as those described as the substituent of $A_0$ of Formula H. $R_{11}$, $R_{12}$ and $R_{13}$ may be form a ring. An aliphatic tertiary amine compound is particularly preferable. The compounds preferably each has an anti-diffusion group or a silver halide adsorption accelerating group in the molecule thereof. A compound having a molecular weight of not less than 100, particularly not less than 300, is preferable for preventing diffusion. As a preferable silver halide adsorption accelerating group, a heterocyclic group, mercapto group, thioether group, thione group or thiourea group are preferably usable.

Examples of nucleation accelerating agent of Na are described below.

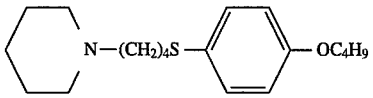

Na-1

$[(C_3H_7)_2N(CH_2)_3OCH_2CH_2]_2S$

Na-2

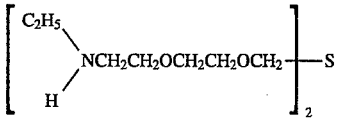

Na-3

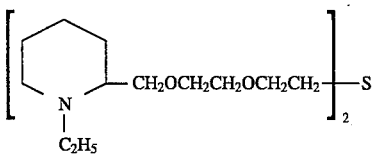

Na-4

-continued
Na-5
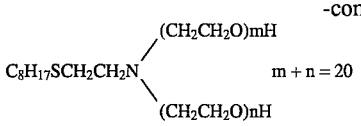
Na-6
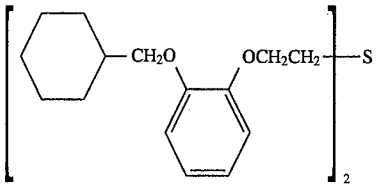
Na-7
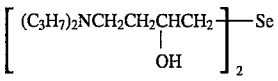
Na-8
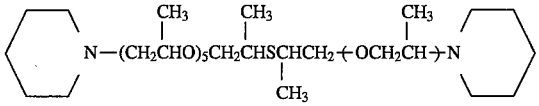
Na-9
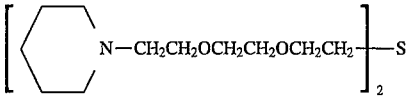
Na-10
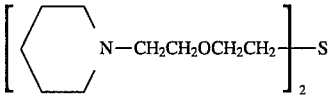
Na-11
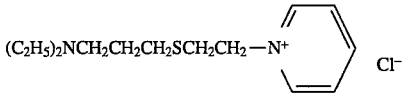
Na-12
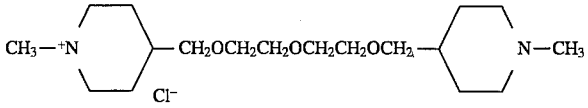
Na-13
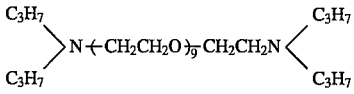
Na-14
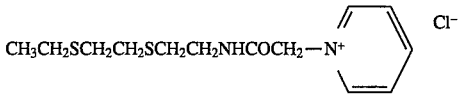
Na-15
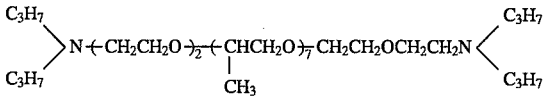
Na-16
$[(C_2H_5)_2N(CH_2)_3NHCOCH_2]_2Se$
Na-17
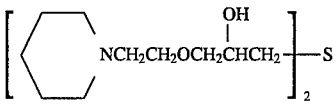
Na-18
$(C_2H_5)_2NCH_2CH_2(OCH(CH_3)CH_2)_7SCH_2CH_2N(C_2H_5)_2$
Na-19
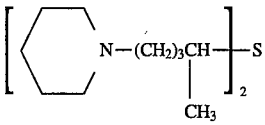

In Formula N-b, Ar represents a substituted or unsubstituted aromatic group or a heterocyclic group. The aromatic group and heterocyclic group may have a substituent. $R_{14}$ represents an alkyl group, an alkynyl group or an aryl group. Ar and $R_{14}$ may be linked with a linking group to form a ring. The compounds preferably have each an anti-diffusion group or a silver halide adsorption accelerating group in the molecule thereof. A compound having a molecular weight of not less than 120, particularly not less than 300, is preferable toprevent diffusion. As a preferable silver halide adsorption accelerating group, the same as those described relating to the compound represented by Formula H can be cited.

Examples of nucleation accelerating agent of [Nb] are described below.

Nb-1

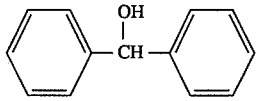

Nb-2

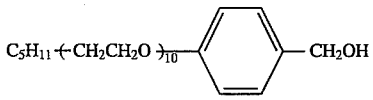

Nb-3

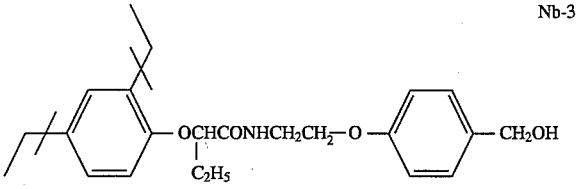

Nb-4

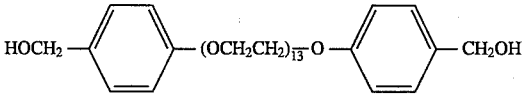

Nb-5

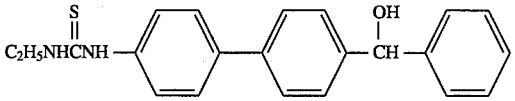

Nb-6

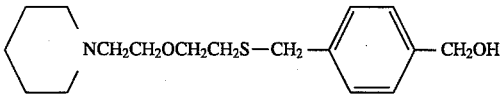

Nb-7

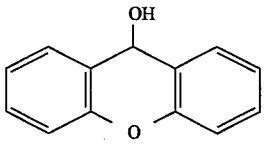

Nb-8

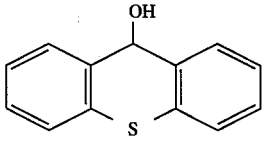

Nb-9

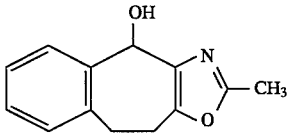

Nb-10

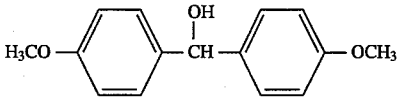

-continued

Nb-11

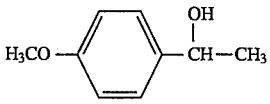

Nb-12

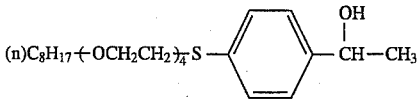

Although the hydrazine compound and the nucleation accelerating agent may be used in any layer provided on the emulsion coated side of the support, it is preferable to be added into a silver halide emulsion layer or a layer adjacent to the emulsion layer. Although the adding amount is varied depending on the size of silver halide grains, composition of silver halide, degree of chemical sensitization and the kind of stabilizer, $10^{-6}$ to $10^{-1}$ moles, particularly $10^{-5}$ to $10^{-2}$ moles, per mole of silver halide is usually preferable.

A silver halide emulsion to be used in the invention may be spectrally sensitized by a sensitizing dye at a required wavelength range. Usable sensitizing dye include a cyanine dye, merocyanine dye, complex cyanine dye, complex merocyanine dye, holopolar cyanine dye, hemicyanine dye, styryl dye and hemioxonol dye. Any basic heterocyclic nuclei usually used in cyanine dyes can be applied to the above dyes, i.e., a nucleus of pyrroline, oxazoline, thiazoline, pyrrole, oxazole, thiazole, selenazole, imidazole, tetrazole and pyridine; nuclei each formed by condensation of the above nuclei with an aliphatic hydrocarbon ring or an aromatic hydrocarbon ring, i.e., a nucleus of indolenine, benzindolenine, indole, benzoxazole, naphthoxazole, benzothiazole, naphthothiazole, benzoselenazole, benzimidazole and quinoline. These nuclei may have a substituent linked with the carbon atom thereof. For the merocyanine dye or the complex merocyanine dye, a 5- or 6-member heterocyclic ring such as a nucleus of pyrazoline-5-one, thiohydantoin, 2-thiooxazolidine-2,4-dione, thiazolidine-2,4-dione, rhodanine or thiobarbituric acid can be applied as a nucleus having a ketomethylene structure. Ones described in Reseach Disclosure No. 176, RD-17643, p.p. 2–3(December 1978), U.S. Pat. Nos. 4,425,425 and 4,425,426 can be used in the concrete. The sensitizing dye may be dissolved by ultrasonic vibration described in U.S. Pat. No. 3,485,634. Method described in U.S. Pat. Nos. 3,482,981, 3,585,195, 3,469,987, 3,425,835, 3,342,605, 3,660,101 and 3,658,546, and British Patent Nos. 1,271,329, 1,038,029 and 1,121,147 can be applied for adding the dye to the emulsion in the form of dissolved or dispersed. The above dyes may be used singly or in combination. A combination of dyes is frequently used for a purpose of super sensitization. Combinations of dyes and substances giving a strong super sensitization effect are described in Research Disclosure No. 176, 17643 (December 1978) p.23, Item IV-J.

Various compounds may be added to the light-sensitive material relating the invention for the purpose of preventing fog formed during a producing process, storage and processing and stabilizing the photographic properties of the light-sensitive material. The usable compounds are ones well-known as an anti-fogging agent or a stabilizing agent, for example, azoles such as benzthiazolium salt, nitroindazoles, nitrobenzimidazoles, chlorobenzimidazoles, brombenzimidazoles, mercaptothiazoles, mercaptothiazoles, mercaptobenzothiazoles, mercaptobenzimidazoles, mercaptothiadiazoles, aminotriazoles, bemzotriazoles, mitrobenzotriazoles and mercaptotetrazoles (particularly 1-phenyl-5-mercaptobtetrazole); mercaptopyrimidines, mercaptotriazines; thioketo compound such as oxazolinethione; azaindenes such as triazaindenes, tetraazaindene (particularly 4-hydroxy-1,3,3a,7-tetraazaindenes) and pentazaindenes; benzenethiosulfonic acid, benzenethiosulfinic acid and benzensulfonamide.

A inorganic or organic hardener may be contained in hydrophilic colloid of the emulsion layer and non-light-sensitive layer of the light-sensitive material of the invention. For example, chromium salts such as chromium alum and chromium acetate, aldehydes such as formaldehyde, glyoxal and glutaraldehyde, N-methylol compounds such as dimethylol urea and dimetylolhydantoin, dioxanes such as 2,3-hydroxydioxane, reactive vinyl compounds such as 1,3,5-triacryloyl-hexahydro-s-triazine, bis(vinylsulfonyl)methyl ether and N,N'-methylene-bis[b-(vinylsulfonyl)-propioneamide], reactive halogen compound such as 2,4-dichloro-6-hydroxy-s-triazine, mucohlogenic acids such as mucochloric acid and phenoxymucochloric acid, isooxazoles, dialdehyde starch and 2-chloro-6-hydroxytriazinyl gelatin can be used singly or in combination.

Well-know surfactants may be used in the light-sensitive emulsion layer and/or non-light-sensitive hydrophilic colloid layer of the light-sensitive material of the invention, for various purposes such as coating aid, anti-static, slipping property improvement, dispersing agent, adhering prevention and photographic property improvement.

Although gelatin is advantageously used as a binder or protective colloid of the photographic emulsion, hydrophilic colloids other than gelatin also may be used. Examples of the hydrophilic colloids other than gelatin include gelatin derivatives, graftpolymers of gelatin and another macromolecular substance, proteins such as albumin and casein, cellulose derivatives such as hydroxyethyl cellulose, carboxymethyl cellulose and cellulose sulfate, a sugar derivative such as sodium arginate and a starch derivative, and various synthetic hydrophilic macromolecular substances such as homo- or co-polymer, for example, polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

Acid-processed gelatin also may be used other than lime-processed gelatin. A hydrolyzed product of gelatin and enzyme decomposition product of gelatin also may be used.

In the photographic emulsion used in the invention may contains a water-insoluble or sparingly soluble synthetic polymer dispersion for the purpose of improving dimension stability. Examples of usable polymer are homo- or co-polymers of a monomer such as an alkyl (metha)acrylate, an alkoxyacryl (metha)acrylate, glycidyl (metha)acrylate, (metha)acrylamide, vinyl ester such as vinyl acetate, acrylonitrile, olefin or styrene, and co-polymers of the above monomer and a monomer such as acrylic acid, methacrylic acid, a,b-unsaturated dicarbonic acid, hydroxy(metha)acrylate, sulfoalkyl(methacrylate) or styrene sulfonic acid.

In the light-sensitive material of the invention, various additives such as a desensitizer, plasticizer, lublicant, development accelerator and oil may be used.

As these additives and the foregoing additives, those described in the above-mentioned Research Disclosure No. 176, p.p. 22–31 are usable.

In the light-sensitive material of the invention, the emulsion layer and the protective layer each may be a single layer or multilayer composed of two or more layers. In the case of multilayer, an interlayer may be provided between the layers. An under-coat layer mainly composed of a hydrophilic colloid may be provided between the emulsion layer and the support.

In the light-sensitive material of the invention, the emulsion layer and another layer are coated on one or both sides of an elastic support which is usually used for a light-sensitive material. The elastic support advantageously usable is a film comprised of a synthetic macromolecular substance such as cellulose acetate, polystyrene, polyethyleneterephthalate.

Various dyes may be contained in the light-sensitive material of the invention for the purpose of improvement safe-light property and image quality (an exposure latitude and linearity). As preferable dyes, those represented by Formula [1] to [6] described in JP O.P.I. No. 7-244349/1995 are cited.

These dyes each have at least one sparingly dissociable proton having a pKa value of 4 to 11, preferably 4.5 to 7.0, in a solvent of water-ethanol mixture solvent with a mixing ratio of 1:1 in volume. Further, in the invention, the dye can be fixed by making a silver complex or a silver salt with silver ions. Preferable dyes which are formable silver salt are ones represented, for example, by Formula {I] to [V] , [I'] to [V'] or [VI] described in JP O.P.I. 5-181230/1993, pages 4 to 28. The concrete dyes are I-1 to 1-37, II-1 to II-5, III-1 to III-7, IV-1 to IV-6, V-1 to 5, I'-1 to I'-12, II'-1 to II'-9, III'-1 to III'-9, IV'-1 to IV'-9, V'-1 to V'-6 and VI-1 to VI-52 described on pages 6 to 46 of the same patent publication.

In the invention, although there is no specific limitation on the method for dispersing the dyes represented by the above Formula [1] to [6], an acid precipitation method, dispersion by a ball mill, jet mill or impeller can be applied.

Although the size of dispersed solid particles of the dye can be optionally set, an average size of 0.01 to 20 μm is preferable and 0.03 to 2 μm is more preferable. The variation coefficient of size distribution of the fine particles of dye is preferable not more than 60%, more preferably not more than 40%.

The black-and-white light-sensitive material of the invention is preferably processed by an automatic processing machine. While the processing, the developer and fixer are each replenished with the amount of replenisher in proportion to the area of the light-sensitive material. The replenishing amount for developer and fixer are each not more than 300 ml/m$^2$, preferably 75 to 200 ml/m$^2$, for reducing the amount of exhaust waste liquid.

In the invention, it is preferable that the total processing time (dry to dry), i.e., the time from insertion of the front end of a film into the automatic processing machine to discharge of the front end of the film from the drying zone of the processing machine, is within the range of 10 to 60 seconds for satisfying the demand of rapid processing. The total processing time means sum of the time necessary for carrying out all processes such as developing, fixing, washing, stabilizing and drying, i.e., time for dry to dry. The total processing time less than 10 minutes causes lowering in the sensitivity and contrast and satisfactory photographic characteristics can hardly be obtained.

The automatic processing machine includes one having a zone for drying the film by a heat conductive member heated at 90° C. or more such as a heat roller maintained at 90° C. to 130° C., or a heat radiating member heated at 150° C. or more such as a heat radiator made from tungsten, carbon, nichrome or a mixture of zirconium oxide, yttrium oxide and thorium oxide in which electric current is directly supplied for heating, or a heat radiator made from a heat radiating material such as copper, stainless steel, nickel or various kind of ceramics which is supplied heating energy from a resistive heat generation member and radiates infrared lay. Developing agents usable in the invention are, for example, dihydroxybenzene such as hydroquinone, chlorhydroquinine, bromohydroquinone, 2,3-dichlorohydroquinine, methylhydroqiunone, isopropylhydroquuinone and 2,5-dimethylhydroquinone; 3-pyrazolidones such as 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone and 1-phenyl-5-methyl-3-pyrazolidone; aminophenols such as o-aminophenol, p-aminophenol, N-methyl-o-aminophenol, N-methyl-p-aminophenol and 2,4-diaminophenol; pyrogallol; ascorbic acid; 1-aryl-pyrazolines such as 1-(p-hydroxyphenyl)-3-aminopyrazoline, 1-(p-methylaminophenyl)-3-aminopyrazoline and 1-(p-amino-N-methylphenyl)-3-aminopyrazoline; transition metal complex salts such as complex salts of Ti, V, Cr, Mn, Fe, Co, Ni and Cu. The complex salts are to be in the form having a reducing ability for developer use, for example, in the form of complex of $Ti^{3+}$, $V^{2+}$, $Cr^{2+}$ or $F^{2+}$. As the lignad of the complex salts, aminopolycarbonic acids such as ethylendiaminetetraacetic acid (EDTA) and diethylenetetaaminepentaacetic acid (DTPA), and phosphoric acids such as hexametaphosphoric acid and tetrapoluphosphoric acid and these salts are exemplified. These developing agent may be used singly or in combination. Usable combination includes a compbination of a 3-pyrazolidone and a dihyroxybenzene, an aminophenol and a hydroxybenzene, a 3-pyrazolidone and ascorbic acid, an aminophenol and ascorbic acid, a 3-pyrazolidone and a transition metal complex salt, and an aminophenol and a transition metal complex salt. The developing agent is preferably used in an amount of 0.01 to 1.4 moles per liter.

In the processing method of the invention, degradation in the photographic properties during running of the processing when a developer containing no hydroquinone is used, which is a problem in usual light-sensitive materials, is considerably improved. As developing agent to be used in place of hydroquinone, a compound represented by the following Formula (1).

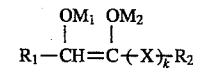

Formula (1)

In the formula, $R_1$ and $R_2$ represent each independently an alkyl group, an amino group or an alkylthio group, $R_1$ and $R_2$ may be linked together to form a ring; k represents 0 or 1; and X represents —CO— or —CS—, when k=1; $M_1$ and $M_2$ represent each a hydrogen atom or an alkali metal atom. The alkyl group, amino group and alkylthio group each may have a substituent.

Preferable substituents of the above-mentioned alkyl group represented by $R_1$ or $R_2$ are, for example, a halogen atom such as a chlorine atom or bromine atom, a hydroxyl group, an aryl group having 6 to 20 carbon atoms such as a phenyl group or naphthyl group, a heterocyclic group such as a 2,2,6,6-tetramethylpiperidinyl group, quinolidinyl group, N,N-diethylpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino or propinonylamino group, and an amino group such as an amino group, methylamino group, dimetylamino group or dibenzylamino group.

Preferable substituents of the above-mentioned amino group represented by $R_1$ or $R_2$ are, for example, a halogen atom such as a chlorine atom or bromine atom, a hydroxyl group, an aryl group having 6 to 20 carbon atoms such as a phenyl group or naphthyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethy-lpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, and an acyl group having 1 to 20 carbon atoms such as an acetyl group, heptanoyl group or propinonyl group.

Preferable substituents of the above-mentioned alkylthio group represented by $R_1$ or $R_2$ are, for example, a halogen atom such as a chlorine atom or bromine atom, a hydroxyl group, an aryl group having 6 to 20 carbon atoms such as a phenyl group or naphthyl group, a heterocyclic group such as a 2,2,6,6-tetramethyl-piperidinyl group, quinolidinyl group, N,N-diethylpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino group or propinonylamino group, and an amino group, methylamino group, dimethylamino group or dibenzylamino group.

Among the compounds represented by Formula (I), compounds represented by the following Formula (I-a) are preferable, in which $R_1$ and $R_2$ of Formula I are linked together to form a ring.

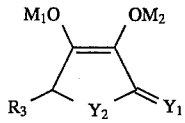

Formula (1-a)

In the formula, $R_3$ represents an alkyl group, an aryl group, an alkoxyl group, a sulfo group, a carboxyl group, an amido group or a sulfonamido group; $Y_1$ represents O or S; $Y_2$ represents O, S or $NR_4$, $R_4$ represents an alkyl group or an aryl group. The groups represented by $R_3$ or $R_4$ each may have a substituent.

Preferable substituents of the above-mentioned alkyl group and alkylthio group represented by $R_4$ are each the same as those described about alkyl group and alkylthio group represented by $R_1$ or $R_2$ of Formula (I), respectively.

Preferable substituents of the above-mentioned aryl group represented by $R_3$ are, for example, a halogen atom such as a chlorine atom or bromine atom, a hydroxyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethylpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino group or propinonylamino group, and an amino group, methylamino group, dimethylamino group or dibenzylamino group.

Preferable substituents of the above-mentioned alkyloxy group represented by $R_3$ are, for example, a halogen atom such as a chlorine atom or bromine atom, a hydroxyl group, an aryl group having 6 to 20 carbon atoms such as a phenyl group or naphthyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethy-lpirazolidinyl group or pyridinyl group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino group or propinonylamino group, and an amino group, methylamino group, dimethylamino group or dibenzylamino group.

Preferable substituents of the above-mentioned sulfo group, carboxy group, amido group or sulfonamido group each represented by $R_3$ are, for example, a halogen atom such as a chlorine atom or bromine atom, a hydroxyl group, an alkali metal atom such as a sodium atom or potassium atom, an aryl group having 6 to 20 carbon atoms such as a phenyl group or naphthyl group, an alkyl group having 1 to 20 carbon atoms such as a methyl group, ethyl group, butyl group, cyclohexyl group, iso-propyl group or dodecyl group, a heterocyclic group such as a 2,2,6,6-tetramethyl-piperidinyl group, quinolidinyl group, N,N-diethy-lpirazolidinyl group or pyridinyl group, an alkoxy group having 1 to 20 carbon atoms such as a methoxy group or ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic-oxy group such as a pyridinyloxy group, an acylamino group having 1 to 26 carbon atoms such as an acetylamino group, heptanoylamino group or propinonylamino group, and an amino group, methylamino group, dimethylamino group or dibenzylamino group.

Although exemplified compounds of Formula (I) or (I-a) are described below, the invention is not limited thereby.

Formula (I)

| Compound No. | X | $R_1$ | $R_2$ | $M_1$ | $M_2$ |
|---|---|---|---|---|---|
| A-1 | — (k = 0) | $HOCH_2CH(OH)-CH(OH)-$ | $-OH$ | H | H |
| A-2 | — (k = 0) | $HOCH_2CH(OH)-CH(OH)-$ | $-OH$ | H | Na |
| A-3 | — (k = 0) | $HOCH_2CH(OH)-CH(OH)-$ | $-CH3$ | H | H |
| A-4 | — (k = 0) | $HOCH_2CH(OH)-CH(OH)-$ | $-C_2H_5$ | H | H |
| A-5 | — (k = 0) | $CH_3CH(OH)-CH(OH)-$ | $-OH$ | H | H |
| A-6 | — (k = 0) | $CH_3CH(OH)-CH(OH)-$ | $-OH$ | H | Na |
| A-7 | — (k = 0) | $CH_3CH(OH)-CH(OH)-$ | $-CH3$ | H | H |
| A-8 | — (k = 0) | $CH_3CH(OH)-CH(OH)-$ | $-CH3$ | Na | H |
| A-9 | — (k = 0) | $CH_3CH(OH)-CH(OH)-$ | $-C_2H_5$ | H | H |
| A-10 | $-C(=O)-$ (k = 1) | $HOCH_2CH(OH)-CH(OH)-$ | $-OH$ | H | H |
| A-11 | $-C(=O)-$ (k = 1) | $HOCH_2CH(OH)-CH(OH)-$ | $-OH$ | Na | H |
| A-12 | $-C(=O)-$ (k = 1) | $HOCH_2CH(OH)-CH(OH)-$ | $-CH3$ | H | H |

-continued

| | | | | | |
|---|---|---|---|---|---|
| A-13 | $-\overset{O}{\overset{\|\|}{C}}-$ (k = 1) | $HOCH_2\underset{OH}{\underset{\|}{CH}}-\underset{OH}{\underset{\|}{CH}}-$ | $-CH3$ | H | Na |
| A-14 | $-\overset{O}{\overset{\|\|}{C}}-$ (k = 1) | $HOCH_2\underset{OH}{\underset{\|}{CH}}-\underset{OH}{\underset{\|}{CH}}-$ | $-C_2H_5$ | H | H |
| A-15 | $-\overset{O}{\overset{\|\|}{C}}-$ (k = 1) | $CH_3\underset{OH}{\underset{\|}{CH}}-\underset{OH}{\underset{\|}{CH}}-$ | $-OH$ | H | H |
| A-16 | $-\overset{O}{\overset{\|\|}{C}}-$ (k = 1) | $CH_3\underset{OH}{\underset{\|}{CH}}-\underset{OH}{\underset{\|}{CH}}-$ | $-OH$ | Na | H |
| A-17 | $-\overset{O}{\overset{\|\|}{C}}-$ (k = 1) | $CH_3\underset{OH}{\underset{\|}{CH}}-\underset{OH}{\underset{\|}{CH}}-$ | $-CH_3$ | H | H |
| A-18 | $-\overset{O}{\overset{\|\|}{C}}-$ (k = 1) | $CH_3\underset{OH}{\underset{\|}{CH}}-\underset{OH}{\underset{\|}{CH}}-$ | $-C_2H_5$ | H | H |
| A-19 | $-\overset{O}{\overset{\|\|}{C}}-$ (k = 1) | $HO-CH_2-$ | $-OH$ | H | H |
| A-20 | $-\overset{O}{\overset{\|\|}{C}}-$ (k = 1) | $HO-CH_2-$ | $-OH$ | H | Na |
| A-21 | $-\overset{O}{\overset{\|\|}{C}}-$ (k = 1) | $HO-CH_2-$ | $-CH_3$ | H | H |
| A-22 | $-\overset{O}{\overset{\|\|}{C}}-$ (k = 1) | $HO-CH_2-$ | $-C_2H_5$ | H | H |
| A-23 | $-\overset{O}{\overset{\|\|}{C}}-$ (k = 1) | $HO-CH_2-$ | $-C_2H_4OH$ | H | H |
| A-24 | $-\overset{O}{\overset{\|\|}{C}}-$ (k = 1) | $HO-CH_2-$ | $-C_2H_4OH$ | H | Na |
| A-25 | $-\overset{S}{\overset{\|\|}{C}}-$ (k = 1) | $HOCH_2\underset{OH}{\underset{\|}{CH}}-\underset{OH}{\underset{\|}{CH}}-$ | $-OH$ | H | H |
| A-26 | $-\overset{S}{\overset{\|\|}{C}}-$ (k = 1) | $HOCH_2\underset{OH}{\underset{\|}{CH}}-\underset{OH}{\underset{\|}{CH}}-$ | $-OH$ | H | Na |
| A-27 | $-\overset{S}{\overset{\|\|}{C}}-$ (k = 1) | $HOCH_2\underset{OH}{\underset{\|}{CH}}-\underset{OH}{\underset{\|}{CH}}-$ | $-CH3$ | H | H |
| A-28 | $-\overset{S}{\overset{\|\|}{C}}-$ (k = 1) | $CH_3\underset{OH}{\underset{\|}{CH}}-\underset{OH}{\underset{\|}{CH}}-$ | $-OH$ | H | H |
| A-29 | $-\overset{S}{\overset{\|\|}{C}}-$ (k = 1) | $CH_3\underset{OH}{\underset{\|}{CH}}-\underset{OH}{\underset{\|}{CH}}-$ | $-OH$ | H | Na |
| A-30 | $-\overset{S}{\overset{\|\|}{C}}-$ (k = 1) | $CH_3\underset{OH}{\underset{\|}{CH}}-\underset{OH}{\underset{\|}{CH}}-$ | $-CH_3$ | Na | H |

Formula (I-a)

| Compound No. | $Y_1$ | $Y_2$ | $R_3$ | $M_1$ | $M_2$ |
|---|---|---|---|---|---|
| A-31 | O | O | H | H | H |
| A-32 | O | O | $CH_3$ | H | H |
| A-33 | O | O | $CH_3$ | H | Na |
| A-34 | O | O | $CH_3$ | Na | H |

-continued

| | | | | | |
|---|---|---|---|---|---|
| A-35 | O | O | $CH_2$<br>\|<br>OH | H | H |
| A-36 | O | O | $CH_2$<br>\|<br>OH | H | Na |
| A-37 | O | O | $CH_3CH$—<br>\|<br>OH | H | H |
| A-38 | O | O | $CH_3CH$—<br>\|<br>OH | H | Na |
| A-39 | O | O | $HOCH_2CH$—<br>\|<br>OH | H | H |
| A-40 | O | O | $HOCH_2CH$—<br>\|<br>OH | H | Na |
| A-41 | O | O | $HOCH_2CH$—<br>\|<br>OH | Na | H |
| A-42 | O | O | $ClCH_2CH$—<br>\|<br>OH | H | H |
| A-43 | O | O | $ClCH_2CH$—<br>\|<br>OH | Na | H |
| A-44 | O | O | $HOOCH_2CH$—<br>\|<br>OH | H | H |
| A-45 | O | O | $HOOCH_2CH$—<br>\|<br>OH | Na | H |
| A-46 | S | O | H | H | H |
| A-47 | S | O | H | H | Na |
| A-48 | S | O | $CH_3CH$—<br>\|<br>OH | H | H |
| A-49 | S | O | $CH_3CH$—<br>\|<br>OH | Na | H |
| A-50 | S | O | $HOCH_2CH$—<br>\|<br>OH | H | H |
| A-51 | S | O | $HOCH_2CH$—<br>\|<br>OH | Na | H |
| A-52 | O | $NCH_3$ | H | H | H |
| A-53 | O | $NCH_3$ | $HOCH_2CH$—<br>\|<br>OH | H | H |
| A-54 | O | $NCH_3$ | $HOCH_2CH$—<br>\|<br>OH | H | Na |
| A-55 | O | NH | $HOCH_2CH$—<br>\|<br>OH | H | H |
| A-56 | O | NH | $HOCH_2CH$—<br>\|<br>OH | Na | H |
| A-57 | O | S | $HOCH_2CH$—<br>\|<br>OH | H | H |

-continued

| | | | | | |
|---|---|---|---|---|---|
| A-58 | O | S | $HOCH_2CH(OH)-$ | Na | H |
| A-59 | O | S | $HOCH_2CH(OH)-$ | H | Na |
| A-60 | O | S | $CH_3CH(OH)-$ | H | H |
| A-61 | S | S | H | H | H |
| A-62 | S | S | H | H | Na |
| A-63 | S | S | $CH_3CH(OH)-$ | H | H |
| A-64 | S | S | $CH_3CH(OH)-$ | Na | H |
| A-65 | S | S | $HOCH_2CH(OH)-$ | H | H |
| A-66 | S | S | $HOCH_2CH(OH)-$ | H | Na |
| A-67 | S | S | $HOCH_2CH(OH)-$ | Na | H |
| A-68 | S | S | $HOCH_2CH(OH)-$ | H | K |

These compounds are typically ascorbic acid, erthorbic acid and their derivatives, which are available on the market or easily can be synthesized by a well-known synthesizing method.

The amount of the above compound represented Formula (1) in a developer is preferably 0.05 to 1 mol/l, particularly 0.1 to 0.5 mol/l.

As another means for enhancing the effect of the invention, it is preferable that the developer contains substantially no dihydroxybenzene compound and that the developer contains transition metal complex salt as a developing agent.

The transition metal complex salt usable as developing agent in the invention includes complex salts of transition metal such as Ti, V, Cr, Mn, Fe, Co, Ni and Cu, in which those of Ti, V, Cr, and Fe are preferable. These compounds should be ones having a reducing ability, for example, complex salts of $Ti^{3+}$, $V^{2+}$, $Cr^{2+}$ and $Fe^{2+}$ are known as developing agent. As ligands, for example, aminopoycarboxylic acid such as ethylenediaminetetraacetic acid (EDTA) and diethylenetriaminepentaacetic acid (DTPA) and their salts, and phosphoric acid such as hexamethapolyphosphoric acid, tetrapolyphosphoric acid and their salts are described. Among them, transition metal complex salts each having a ligand of EDTA or DTPA are preferably used.

Examples of preferable ligands are shown below, but usable ligands are not limited thereto.

(1) Ethylenediaminetetraacetic acid (EDTA)
(2) Diethylenetriaminepentaacetic acid (DTPA)
(3) Triethylenetetraminehexaacetic acid (TTHA)
(4) Hydroxyethylethylenediaminetriacetid acid (HEDTA)
(5) Nitrilotriacetic acid (NTA)
(6) 1,2-diaminocyclohexanetetraacetic acid
(7) 1,3-diamino-2-propanoltetraacetic acid
(8) Hexametapolyphosphic acid
(9) Tetrapolyphosphic acid Preferable examples of compounds other than the above are those described on pages 128(2) to 129(3) of Japanese Patent No. 54-41899/1979.

The complex salt relating to the invention, may be produced in a developer by adding a transition metal salt and ligand compound to the developer. The preferable content of the complex salt relating to the invention in the developer is 1 to 100 g per liter.

In the present invention, it is preferable that the developer substantially does not contain any hydroquinone compound such as hydroquinone, bromohydroquinone, methylhydroquinone or hydroquinonemonosulfonate. "Substantially does not contain" means that the content is less than 0.01 mole per liter.

In the invention, the developing agent of transition metal complex salt may be used in combination with a developing agent of 3-pryazolidones such as 1-phenyl-3-pyrazolidone, 1-phenyl-4-methyl-3-pyrazolidone, 1-phenyl-4,4'-dimethyl-3-prazolidone, 1-phenyl-4-ethyl-3-pyrazolidone and 1-phenyl-5-methyl-3-pyrazolidone, or aminophenols such as o-aminophenol, p-aminophenol, N-methyl-o-aminophenol, N-methyl-p-aminophenol and 2,4-diaminophenol. When the developing agents are used in combination, a developing agent of 3-pyrazolidones or aminophenols is preferably contained in the developer in an amount of 0.01 to 1.4 moles per liter.

In the developer, a silver sludge preventing agent described in JP No. 62-4702/1987, JP O.P.I. Nos. 3-51884/1991, 4-26838/1992, 4-362942/1992 and 1-319031/1989 is preferably contained.

The developer can be regenerated by applying an electric current. In concrete, a cathode made of an electric conductor such as a stainless steel wool, or a semiconductor and an anode made of an insoluble electric conductor such as carbon, gold, platinum or titanium, are provided in a developer to be regenerated and a solution of an electrolyte, respectively. The tank of the developer to be regenerated and the tank of the solution of electrolyte are being contacted through an anionic ion-exchange membrane, and an electric current supplied to the electrodes to regenerate the developer. The light-sensitive material of the invention can be processed while the developer is regenerated. At the time of regeneration, various additives to be added to a developer such as preservatives, alkaline agents, pH buffers, sensitizing agents, antifoggant, silver sludge preventing agents can be replenished to the developer. The above additives can be supplied to the developer also in a course of processing of the light-sensitive material while applying an electric current for regeneration. When the developer is regenerated, the transition metal complex salts are preferably used as the developing agents.

Sulfites and metabisulfites usable as the preservative in the invention include, for example, sodium sulfite, potassium sulfite, ammonium sulfite and sodium sulfite. Using amount of the sulfite is preferably not less than 0.25 moles, particularly not less than 0.4 moles, per liter.

To the developer, an alkaline agent such as sodium hydroxide or potassium hydroxide, a pH buffer such as a carbonate, a phosphate, a borate, boric acid, citric acid or alkanolamine, a dissolving assisting agent such as a polyethylene glycol, an ester thereof or alkanolamine, sensitizer such as a nonionic surfactant including polyoxyethylene or a quartenary ammonium compound, a surfactant, a defoaming agent, an atifoggant such as a halide salt, for example, potassium bromide or sodium bromide, nitrobenzimidazole, benztriazole, benzothiazole, a tetrazole or a thiazole, chelating agent such as ethylenediaminetetraacetic acid or alkali metal salt thereof, nitrirotriacetate or polyphosphate, a development accelerating agent such as a compound described in U.S. Pat. No. 2,304,025 and Japanese Patent 47-45541/1972, a hardener such as glutaraldehyde or bisulfite adduct thereof, and a defoaming agent may be added according to necessity. It is preferable to control pH value of the developer to within the range of 8.5 to 10.5 for carrying out the processing for a time of not more than 60 seconds in total (dry to dry).

As the fixer, one having a usual composition can be used. The fixer is usually a solution comprising a fixing agent and other components, and the pH value thereof is usually 3.8 to 5.8. As the fixing agent, sulfates such as sodium thiosulfate, potassium thiosulfate and ammonium thiosulfate, thiocyanates such as sodium thiocyanate, potassium thiocyanate and ammonium thiocyanate, and organic sulfur compounds known as fixing agents which are each able to form a soluble stable silver complex salt, can be used.

According to necessity, the fixer may contains a preservative such as sulfites and bisulfites, pH buffers such as acetic acid, pH adjusting agents such as sulfuric acid and a chelating agents having a water softening ability.

The developer may be in various forms such as a mixture of solid compositions, an aqueous solution containing an organic solvent such as glycol or amine, or a paste-like viscous solution, which may be use with or without dilution.

The temperature of developer in the invention may be set in an ordinary temperature rage of 20° to 30° C. or a high temperature range of 30° to 40° C.

EXAMPLES

The effect of the invention is concretely described below. However, the invention is not limited thereto.

Example 1

Preparation of silver halide emulsion A

Core particles of silver chlorobromide composed of 95 mole % of silver chloride and remaining amount of silver bromide and having an average size of 0.15 μm were prepared by a double-jet mixing method. At the time of formation of the core particles, $8\times10^{-8}$ moles per mole of silver of $K_3Ru(NO)_4(H_2O)_2$ and $8\times10^{-6}$ moles per mole of silver of $K_3OsCl_6$ are added. On each the core particle a shell was formed by a double-jet method. At this time $3\times10^{-7}$ moles per mole of silver of $K_2IrCl_6$ and $3\times10^{-7}$ moles per mole of silver of thallium nitrate are added. Conversion treatment was applied using fine particles of silver iodide. Thus obtained silver halide emulsion comprises core/shell type monodisperse cubic silver grains composed of 90 mole % of silver chloride, 0.2 mole % of silver iodide and remaining amount of silver bromide and having an average size of 0.2 μm and a variation coefficient of size distribution of 10%. Then the emulsion was desalted by making use of a modified gelatin described (exemplified compound G-8 in JP O.P.I. No. 2-280129, in which amino group of gelatin substituted by phenylcarbamoyl group). $E_{Ag}$ value of the emulsion after desalting was 190 mV at 50° C. $E_{Ag}$ is a value of potential measured by a measuring electrode HA101 and a standard electrode HS205C manufactured by Toa Denpa Kogyo Co.

Preparation of silver halide emulsion B

Silver halide emulsion B was prepared in the same manner as in silver halide emulsion A except that $K_3OsCl_6$ is replaced by $3.0\times10^{-7}$ mole/mole of silver and mixing temperature was controled so that the grain size is made to be 0.14 μm.

To thus obtained emulsion, $1\times10^{-3}$ moles per mole of silver of 4-hydroxy-6-methyl-1,3,3a,7-tetraazaindene was added. Then the values of pH and $E_{Ag}$ of the emulsion were adjusted to 5.6 and 123 mV by making use of potassium bromide and citric acid. The emulsion was chemically ripened at 60° C. after addition of $1\times10^{-3}$ moles per mole of silver of sodium p-toluenethiosulfonate and sulfur compound $S_8$ so as to obtain a maxim sensitivity. After completion of the ripening, $2\times10^{-3}$ moles per mol of silver of 4-hydroxy-6-methyl-1,3,3a,7-tetrazaindene, $3\times10^{-4}$ moles per mol of silver of 1-phenyl-5-mercaptotetrazole, phthalated gelatin and 300 mg per mol of silver of potassium iodide were added to the emulsion.

Preparation of light-sensitive material for graphic art scanner use containing a hydrazine derivative On a support, a gelatin under-coat layer according to the following Receipt 1 was coated so that the coating amount of gelatin to be 0.5 g/m$^2$. On the under-coat layer, a silver halide emulsion layer 1 according to Receipt 2, a interprotective layer according to Receipt 3, a silver halide emulsion layer 2 according to Receipt 4 and an emulsion protective layer according to Receipt 5 were simultaneously coated in this order from the support. The coating amount of the emulsion layer 1 was 2.0 g/m$^2$ in terms of silver and 1,0 g/m$^2$ in terms of gelatin, that of the interlayer was 0.3 g/m$^2$ in terms of gelatin, that of the emulsion layer 2 was 0.8 g/m$^2$ in terms of silver and 0.4 g/m$^2$ in terms of gelatin, and that of protective layer was 0.6 g/m$^2$ in terms of gelatin.

On a subbing layer provided on the other side of the support, a backing layer according to Receipt 6, a polymer layer according to Receipt 7 and a backing protective layer according to Receipt 8 were simultaneously coated in this order from the support by curtain coating method with a speed of 200 m/minute. The coating amounts of the backing layer and the backing protective layer were each 0.6 g/m$^2$ and 0.4 g/m$^2$ in terms of gelatin, respectively. The coating of the layers on backing side was simultaneously with that of the layers on the emulsion side of the support.

| | |
|---|---|
| Receipt 1 (Composition of the gelatin under-coat layer) | |
| Gelatin | 0.5 g/m$^2$ |
| Dye a (powder dispersed by a ball mill so as the particle size to be 0.1 μm) | 25 mg/m$^2$ |
| Dye b (crystals having an average size of 0.08 μm which was precipitated from alkaline solution of the dye by citric acid) | 20 mg/m$^2$ |
| sodium polystyrenesulfonate (average molecular weight: 500000) | 10 mg/m$^2$ |
| Redox compound RE-1 | 4 mg/m$^2$ |
| S-1 (sodium-iso-amyl-n-decylsulfosuccinate) | 0.4 mg/m$^2$ |
| Receipt 2 (Composition of silver halide emulsion layer 1) | |
| Silver halide emulsion A (in terms of silver) | 2.0 g/m$^2$ |
| Sensitizing dye d-1 | 6 mg/m$^2$ |
| Sensitizing dye d-2 | 3 mg/m$^2$ |
| Hydrazine compound (solid dispersion) | 5 mg/m$^2$ |
| Redox compound RE-1 | 0.4 mg/m$^2$ |
| Amino compound AM-1 | 40 mg/m$^2$ |
| Compound e | 100 mg/m$^2$ |
| Polymer latex f | 1.0 g/m$^2$ |
| Hardener g | 5 mg/m$^2$ |
| S-1 | 0.7 mg/m$^2$ |
| Saponine | 20 mg/m$^2$ |
| 2-mercapto-6-hydroxypurine | 10 mg/m$^2$ |
| Dye a (powder dispersed by a ball mill so as the particle size to be 0.1 μm) | 2.5 mg/m$^2$ |
| Dye b | 20 mg/m$^2$ |
| Ascorbic acid | 20 mg/m$^2$ |
| EDTA | 50 mg/m$^2$ |
| Sodium polystyrenesulfonate a | 10 mg/m$^2$ |
| Receipt 3 (composition of the inter layer) | |
| Gelatin | 0.3 g/m$^2$ |
| S-1 | 2 mg/m$^2$ |
| Sodium polystyrenesulfonate a | 10 mg/m$^2$ |
| polymer latex f | 0.3 g/m$^2$ |
| Redox compound RE-1 | 0.4 mg/m$^2$ |
| Dye a (powder dispersed by a ball mill so as the particle size to be 0.1 μm) | 2.5 mg/m$^2$ |
| Receipt 4 (Composition of silver halide emulsion layer | |
| Silver halide emulsion B (in terms of silver) | 0.8 g/m$^2$ |
| Sensitizing dye d-1 | 0.5 mg/m$^2$ |
| Hydrazine compound A (Solid dispersion) | 2.5 mg/m$^2$ |
| Amino compound AM-1 | 20 mg/m$^2$ |
| Redox compound RE-1 | 4 mg/m$^2$ |
| Dye a (powder dispersed by a ball mill so as the particle size to be 0.1 μm) | 2.5 mg/m$^2$ |
| S-1 | 1.7 mg/m$^2$ |
| Styrene-maleic acid copolymer (Molecular weight: 70,000) Phthalated gelatin was used, pH of the solution was 4.8. | 10 mg/m$^2$ |
| Receipt 5 (Composition of protective layer) | |
| Gelatin | 0.6 mg/m$^2$ |
| Dye c (powder dispersed by a ball mill so as the particle size to be 0.1 μm) | 40 mg/m$^2$ |
| Redox compound RE-1 | 4 mg/m$^2$ |
| S-1 | 12 mg/m$^2$ |
| Matting agent: | |
| Spherical polymethyl methacrylate, average size: 3.5 μm | 25 mg/m$^2$ |
| Irregular-shape silica, average size: 8 μm | 12.5 mg/m$^2$ |
| 1,3-vinylsulfonyl-2-propanol | 40 mg/m$^2$ |
| Redox compound RE-1 | 4 mg/m$^2$ |
| Surfactant h | 1 mg/m$^2$ |
| Lublicant (silicone oil) | 4 mg/m$^2$ |
| Colloidal silica (average size: 0.05 μm) | 20 mg/m$^2$ |
| Hardener j | 30 mg/m$^2$ |
| Sodium polystyrenesulfonate a | 10 mg/m$^2$ |

-continued

| | |
|---|---|
| Receipt 6 (Composition of the backing layer) | |
| Gelatin | 0.6 g/m$^2$ |
| S-1 | 5 mg/m$^2$ |
| Latex polymer f | 0.3 mg/m$^2$ |
| Colloidal silica, average size: 0.05 μm | 70 mg/m$^2$ |
| Sodium polystyrenesulfonate a | 10 mg/m$^2$ |
| Compound i | 100 mg/m$^2$ |
| Receipt 7 (Composition of the polymer layer) | |
| Latex j (methyl methacrylate:acrylic acid = 97:3) | 1.0 g/m$^2$ |
| Hardener g | 6 mg/m$^2$ |
| Receipt 8 (Composition of Backing protective layer) | |
| Gelatin | 0.4 g/m$^2$ |
| Matting agent: Monodisperse polymethyl methacrylate, average size: 5 μm | 50 mg/m$^2$ |
| Sodium di-(2-ethylhexyl)-sulfosuccinate | 10 mg/m$^2$ |
| Surfactant h | 1 mg/m$^2$ |
| Dye k | 20 mg/m$^2$ |
| $H-(OCH_2CH_2)_{68}-OH$ | 50 mg/m$^2$ |
| Hardener g | 20 mg/m$^2$ |
| Sodium polystyrenesulfonate | 10 mg/m$^2$ |
| Base-releasing metal compound of the invention | See Table 1 |

Sensitizing dye d-1

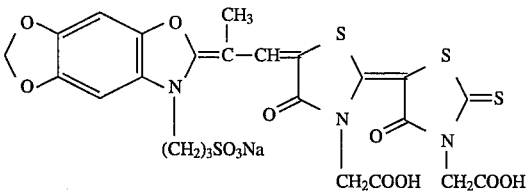

Sensitizing dye d-2

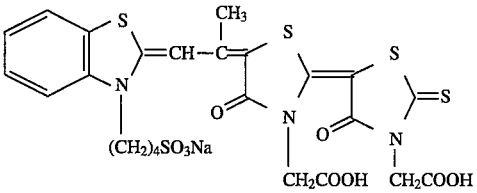

Compound e

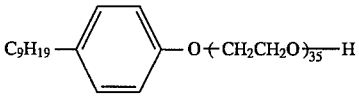

Latex polymer f

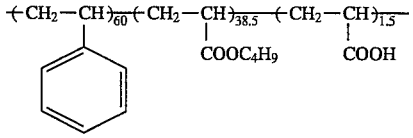

Hardener g

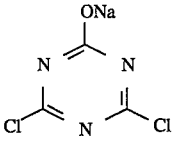

Hardener j

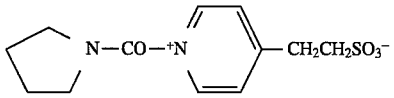

-continued
Surfactant h
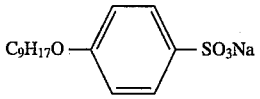
Compound i
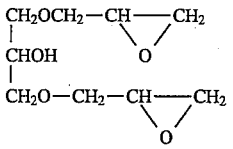
Dye k
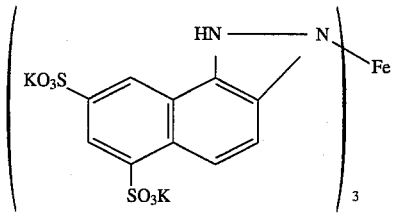
Dye a
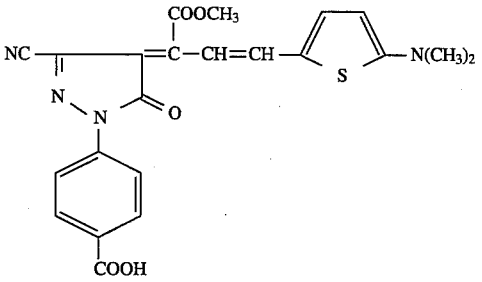
Dye b
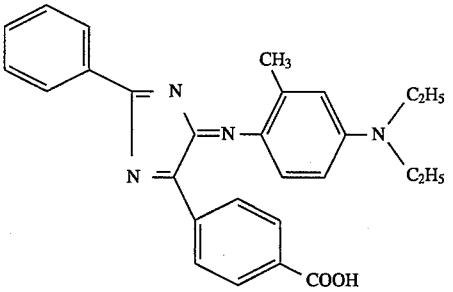
Dye e
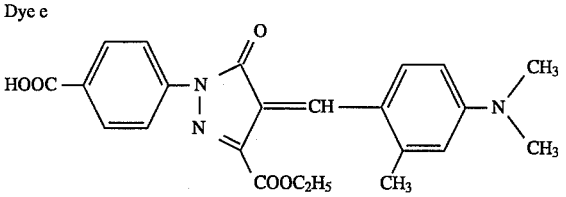
Amino compound AM-1
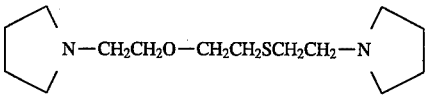

-continued

Hydrazine compound A

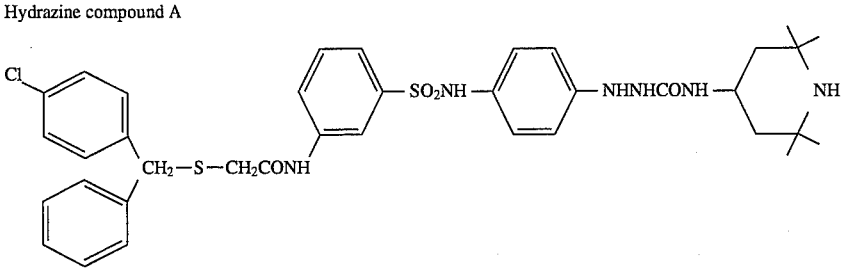

Redox compound RE-1

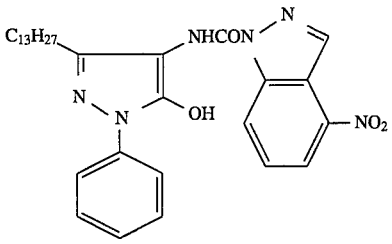

Sample No. 1 was prepared according to the above receipts except that the redox compound RE-1 and the base-releasing metal compound in the backing protective layer were omitted. Sample No. 2 was prepared in the same manner as in Sample No. 1 except that the redox compound RE-1 was added according to the above receipt. Further sample No. 3 was prepared in the same manner as in Sample No. 2 except that $1.0\times10^{-2}$ moles per square meter of zinc hydroxide was added in the silver halide emulsion layer 1. Samples No. 4 through No. 11 were prepared in the same manner as in Sample No. 2 except that the base-releasing compounds were added as shown in Table 1.

Thus obtained samples were each contacted with an optical wedge and exposed to light of 633 nm simulating He-Ne laser light. The exposed samples were processed with the following developer and fixer by a rapid automatic processor GR-26SR produced by Konica Corp. under the following conditions. On the other hand, for evaluation the quality of fine dot, the samples were each exposed to light through a 8 μm random pattern screen (FM screen) by a contact printer SG-747RU produced by Dai-Hihon Screen Co., Ltd. and processed in the same manner as above. Further, the processing was run for 8 days while processing 100 sheets of 508 mm×610 mm size film per day. The developer and fixer were each repenished in a rate of 120 ml per square meter of film, respectively. Eighty percent of the area of the film to be processed was exposed to light for blackening in advance of the processing. The total number of the processed film was 800 sheets. The properties of the samples processed by the solutions before running (fresh solutions) and by those after running were compared.

| (Composition of developer)<br>Amount for 1 liter of using solution | |
|---|---|
| Penta-sodium diethylenetriaminepentaacetate | 3 g/l |
| Sodium sulfite | 42.5 g/l |
| Potassium sulfite | 17.5 g/l |
| Potassium carbonate | 55 g/l |
| Hydroquinone | 21 g/l |
| 1-phenyl-5-mercaptotetrazole | 0.03 g/l |
| 4-methyl-4-hydroxymethyl-1-phenyl-3-pyrazolidone (Dimeson S) | 0.9 g/l |

-continued

| | |
|---|---|
| benzotriazole | 0.2 g/l |
| Potassium bromide | 5 g/l |
| Boric acid | 4 g/l |
| Diethylene glycol | 40 g/l |
| 8-mercaptoadenine | 0.06 g/l |
| Water to make 1 liter and adjust pH to 10.2 by using KOH. | |
| (Composition of fixer)<br>Amount for 1 liter of using solution | |
| Anmonium thiosulfate (70% aqueous solution) | 200 ml/l |
| Sodium sulfite | 22 g/l |
| Boric acid | 9.8 g/l |
| Sodium acetate trihydrate | 34 g/l |
| Acetic acid (90% aqueous solution) | 14.5 g/l |
| Tartaric acid | 3.0 g/l |
| Aluminum sulfate (27% aqueous solution) | 25 ml/l |
| Adjust pH to 4.9 with sulfuric acid | |

(Processing conditions)

| Process | Temperature | Time |
|---|---|---|
| Developing | 38° C. | 12 sec. |
| Fixing | 35° C. | 10 sec. |
| Washing | 40° C. | 10 sec. |
| Drying | 50° C. | 12 sec. |
| Total | | 44 sec. |

Evaluation of sensitivity and gamma

The processed samples were subjected to densitometry by PDA-65 (Digital densitometer produced by Konica Corp.). The sensitivity shown in the following tables are relative values when the sensitivity at a density point of 3.0 of Sample No. 2 is set to 100. The gamma is a value of tangent of density points of 0.1 and 3.0. A gamma value of less than 7 is not acceptable in the practical use and that of 7 to 10 is also insufficient. A light-sensitive material having a gamma value of more than 10 gives a ultra high contrast image and is suitable for practical use.

Evaluation of black-spot

The processed samples were visually observed through a 100 times magnifier and classified to five ranks, 5 to 1 according to the black-spot formation in order of small to large number of formed black-spots. The level of black-spot formation ranked as 1 or 2 is unacceptable for practical use.

Evaluation method of linearity and dot quality

The samples exposed through the 8 μm random patter screen (FM-screen) by SG-747RU were visually observed through a 100 times magnifier to evaluate the quality (sharpness) of dot. The best quality of the dot is ranked as 5 and ranks are lowered 4, 3, 2 and 1 according to degradation of the dot quality. The level of dot quality ranked as 1 or 2 is a level unacceptable for practical use. The linearity was determined by the percentage of the reproduced dots which are theoretically to be reproduced to 95%, when the sample is exposed so that the dots to be theoretically reproduced to 2% are actually reproduced to 2%. It is preferable that the percentage of the reproduced dots is near to 95%. Determination was carried out by a dot-meter X-Rite 361T.

Results by the processing with the fresh processing solutions are shown in Table 1, and those with the solutions after running were shown in Tables 2 and 3.

In results of the above test, result of Samples Nos. 4 to 11 processed by the fresh processing solutions were all the same as those of Sample 2. Sample 4 to 11 were all the same as Sample No. 2 except that the base-releasing metal compounds were added to the backing layer thereof.

TABLE 1

| Sample No. | Backing protective layer | Redox compound | Sensitivity | γ | Black-spot | Dot | Linearity |
|---|---|---|---|---|---|---|---|
| 1 | — | — | 110 | 20 | 5 | 5 | 99.5 |
| 2 | — | RE-1 | 100 | 17 | 5 | 5 | 97.8 |
| 3 | Zinc hydroxide | RE-1 | 105 | 18 | 5 | 5 | 98.3 |

TABLE 2

| No. | Compound | Added amount moles/m² | Sensitivity | γ | Black-spot | |
|---|---|---|---|---|---|---|
| 1 | — | — | 55 | 8 | 1 | Comp. |
| 2 | — | — | 45 | 5 | 1 | Comp. |
| 3 | Zinc hydroxide | $1.0 \times 10^{-2}$ | 65 | 10 | 1 | Comp. |
| 4 | Zinc hydroxide | $1.0 \times 10^{-2}$ | 103 | 18 | 4 | Inv. |
| 5 | Zinc hydroxide | $1.0 \times 10^{-3}$ | 88 | 15 | 5 | Inv. |
| 6 | Zinc oxide | $1.0 \times 10^{-2}$ | 104 | 19 | 5 | Inv. |
| 7 | Zinc oxide | $1.0 \times 10^{-3}$ | 92 | 14 | 5 | Inv. |
| 8 | Calcium carbonate | $1.0 \times 10^{-2}$ | 98 | 17 | 4 | Inv. |
| 9 | Calcium carbonate | $1.0 \times 10^{-3}$ | 87 | 13 | 5 | Inv. |
| 10 | Aluminum hydroxide | $1.0 \times 10^{-2}$ | 97 | 15 | 5 | Inv. |
| 11 | Aluminum hydroxide | $1.0 \times 10^{-3}$ | 85 | 11 | 5 | Inv. |

Samples No. 4 to 11 in the table are the same as Sample No. 2 except that the base-releasing metal compounds were added to the backing side thereof.

The base-releasing metal compounds were dispersed by using 0.1 μm beads in water in the presence of a surfactant, and added to the backing protective layer coating solution. The solubilities of the base-releasing compounds in water at 20° C. were all not more than 0.1% by weight.

TABLE 3

| No. | Lineality (%) | Dot quality | |
|---|---|---|---|
| 1 | 99.8 | 2 | Comparative |
| 2 | 100 | 1 | Comparative |
| 3 | 100 | 1 | Comparative |
| 4 | 97.6 | 5 | Inventive |
| 5 | 98.2 | 5 | Inventive |
| 6 | 97.5 | 5 | Inventive |
| 7 | 98.4 | 5 | Inventive |
| 8 | 98.2 | 5 | Inventive |
| 9 | 98.7 | 4 | Inventive |
| 10 | 98.0 | 5 | Inventive |
| 11 | 98.6 | 5 | Inventive |

It is understood that the samples of the invention are high in the sensitivity and gamma and low in the formation of black-spot. Further, it is also understood that fluctuation in the sensitivity and degradation in the dot quality and dot reproducibility are prevented when the samples are rapidly processed by the automatic processor with replenishing by lowered amounts of replenisher solutions.

Example 2

Samples Nos. 1 to 4 and 9 prepared in Example 1 were evaluated in the same manner as in Example 1 except that the receipt of developer was changed to the following which contains no hydroquinone.

| (Composition of the developer) Amounts for 1 liter of using solution | |
|---|---|
| Sodium sulfite | 40.0 g/l |
| Potassium carbonate | 70 g/l |
| A-17 | 25 g/l |
| Dimeson S | 1.0 g/l |
| DTPA 銅5N | 1.45 g/l |
| 1-phenyl-5-mercaptotetrazole | 0.03 g/l |
| 5-methylbenzotriazole | 0.2 g/l |
| Potassium bromide | 5 g/l |
| Boric acid | 4 g/l |
| Diethylene glycol | 40 g/l |
| 8-mercaptoadenine | 0.06 g/l |

A fixer the same as in Example 1 was used.

| (Processing conditions) Process | Temperature | Time |
|---|---|---|
| Developing | 38° C. | 12 sec. |
| Fixing | 35° C. | 10 sec. |
| Washing | 40° C. | 10 sec. |
| Drying | 50° C. | 12 sec. |
| Total | | 44 sec. |

Test results are listed in Tables 4 and 5.

TABLE 4

| | Fresh solution | | | | | |
|---|---|---|---|---|---|---|
| No. | Sensitivity | γ | Black-spot | Lineality | Dot quality | |
| 1 | 110 | 21 | 5 | 100 | 5 | Comparative |
| 2 | 102 | 17 | 5 | 97.8 | 5 | Comparative |
| 3 | 106 | 19 | 5 | 100 | 5 | Comparative |
| 4 | 108 | 17 | 5 | 97.8 | 5 | Inventive |
| 9 | 198 | 17 | 5 | 100 | 5 | Inventive |

TABLE 5

| | Fresh solution | | | | | |
|---|---|---|---|---|---|---|
| No. | Sensitivity | γ | Black-spot | Lineality | Dot quality | |
| 1 | 53 | 8 | 5 | 100 | 5 | Comparative |
| 2 | 40 | 4 | 5 | 97.8 | 5 | Comparative |
| 3 | 55 | 8 | 5 | 100 | 5 | Comparative |
| 4 | 105 | 19 | 5 | 97.8 | 5 | Inventive |
| 9 | 97 | 14 | 5 | 100 | 5 | Inventive |

As is shown in Tables 5 and 6, the samples of the invention maintain excellent properties when processed the developer without hydroquinone after running.

What is claimed is:

1. A method for processing a black-and-white silver halide photographic light-sensitive material comprising the steps of developing an imagewise exposed black-and-white silver halide photographic light-sensitive material with a developing solution in the presence of a complex forming compound, fixing said developed light-sensitive material with a fixing solution, washing or stabilizing said fixed light-sensitive material with water or a stabilizing solution, respectively, and drying said washed or stabilized light-sensitive material, wherein said light-sensitive material comprises a support and at least one silver halide emulsion layer and optionally one or more non-light-sensitive hydrophilic colloid layers provided on a first side of said support, and a layer provided on a second side opposite to said first side of said support, and at least one of said silver halide emulsion layer and said non-light sensitive hydrophilic layer adjacent to said silver halide emulsion layer provided on said first side of said support contains a hydrazine compound, at least one of said silver halide emulsion layer and said non-light sensitive hydrophilic layers provided on said first side of said support contains a redox compound capable of releasing a development inhibitor upon oxidation reaction, said layer provided on said second side of said support contains a sparingly water-soluble metal compound capable of releasing a base upon reaction with said complex forming compound.

2. The method of claim 1, wherein said processing is carried out by an automatic processor in which a developing solution, a fixing solution are charged and said developing solution and said fixing solution are each replenished with a developer replenishing solution and a fixer replenishing solution, respectively, in a ratio of 300 ml per square meter of the light-sensitive material to be processed.

3. The method of claim 1, wherein the processing is carried out for a time of 10 seconds to 60 seconds in total.

4. The method of claim 1, wherein said hydrazine compound is a compound represented by the following Formula H;

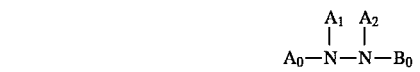

Formula H wherein $A_0$ is an aliphatic group or an aromatic group; $B_0$ is a group represented by $—G_0—D_0$ in which $G_0$ is —CO—, —COCO—, —CS—, $—C(=NG_1D_1)—$, —SO—, $—SO_2—$ or $—P(O)(G_1D_1)$, $G_1$ is a simple liking group, —O—, —S— or $—N(D_1)$, $D_1$ is an aliphatic group, an aromatic group or a heterocyclic group or a hydrogen atom, and $D_0$ is an aliphatic group, an aromatic group, a heterocyclic group, an amino group, an alkoxy group or a mercapto group; and one $A_1$ and $A_2$ is a hydrogen atom and another one of $A_1$ and $A_2$ is a hydrogen atom, an acyl group, a sulfonyl group or an oxalyl group.

5. The method of claim 1, wherein said hydrazine compound is contained in said silver halide emulsion or said hydrophilic colloid layer in an amount of $1\times10^{-5}$ to $1\times10^{-2}$ moles per mole of silver.

6. The method of claim 1, wherein said redox compound is a compound represented by the following Formula R;

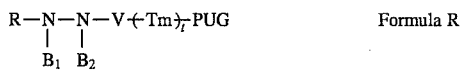

Formula R wherein $B_1$ and $B_2$ are each a hydrogen atom or a residue of sulfonic acid, or one of $B_1$ and $B_2$ is a hydrogen atom and the other one is a residue of sulfinic acid or $—[C(O)]_l—R_0$ in which $R_0$ is an alkyl group, an alkenyl group, an aryl group, an alkoxy group or an aryloxy group and l is 1, 2 or 3; Tm is a divalent linking group; t is an integer of 0 or 1; V is a carbonyl group, —C(O)C(O)—, a sulfonyl group, a sulfoxy group, a $—P(O)—R_1$ group in which $R_1$ is an alkoxy group or an aryloxy group or a thiocarbonyl group, PUG is a residue of development inhibitor; and R is an alkyl group, an alkenyl group, an alkynyl group, an aryl group, or a heterocyclic group.

7. The method of claim 1, wherein said redox compound is contained in said hydrophilic colloid layer in an amount of $1.0\times10^{-6}$ moles to $1\times10^{-2}$ moles per mole of silver contained in said silver halide emulsion layer.

8. The method of claim 1, wherein said metal compound is a compound having a solubility of not more than 0.5 g in 100 g of water at 20° C. and represented by $T_mX_n$, in which T is a transition metal atom or a alkali-earth metal atom; X is an ion capable of being a counter ion of M contained in said complex forming compound, and m and n are each an integer necessary to equalize the valences of the atoms of T and M.

9. The method of claim 1, wherein said metal compound is contained in said backing layer in an amount of 0.01 $g/m^2$ to 20 $g/m^2$.

10. The method of claim 1, wherein said complex forming compound is a compound capable of forming a complex salt having a stability constant in terms of log K of not less than 1 with a metal ion composing said metal compound.

11. The method of claim 10, said complex forming compound is a salt of an aminocarbonic acid, an iminodiacetic acid, an anilinocarbonic acid, a pyridinocarbonic acid, an aminophosphoric acid of a carbonic acid with an alkali metal, a guanidine, an amidine or a quartenary ammonium.

12. The method of claim 11, wherein said complex forming compound is a compound represented by the following Formula;

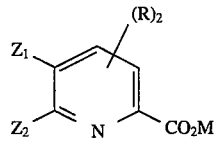

wherein R is a hydrogen atom, a halogen atom, an alkoxy group, a $—CO_2M$ group, a hydroxycarbonyl group, an amino group or an alkyl group, two groups each represented by R may be the same or different; M is an alkali metal, a guanidine, an amidine or a quartenary ammonium; $Z_1$ and $Z_2$ are each a hydrogen atom, a halogen atom, an alkoxy group, a $—CO_2M$ group, a hydroxycarbonyl group, an amino group or an alkyl group and $Z_1$ and $Z_2$ may be linked to for m a ring condensed with the pyridine ring.

13. The method of claim 1, wherein said developing solution contains a compound represented by the following Formula 1 and said developing solution contains no hydroquinone,

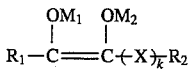

Formula 1 wherein are each an alkyl group, an amino group, an alkylthio group, $R_1$ and $R_2$ each represent alkyl, amino, or alkylthio, or $R_1$ and $R_2$ may be linked together to form a ring; k is an integer of 0 or 1, and X is a —CO— group or a —CS— group when k is 1; and $M_1$ and $M_2$ are each a hydrogen atom or an alkali metal atom.

14. The method of claim 13, wherein said compound represented by Formula 1 is a compound represented by the following Formula 1-a;

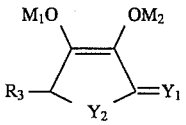

Formula 1-a wherein $R_3$ is a hydrogen atom, an alkyl group, an aryl group, an amino group, an alkoxy group, a sulfo group, a carboxyl group, an amido group or a sulfonamido group; $Y_1$ is O or S; and $Y_2$ is O, S or $NR_4$, and $R_4$ is an alkyl group or an aryl group; and $M_1$ and $M_2$ are each a hydrogen atom or an alkali metal atom.

* * * * *